US009274461B2

(12) United States Patent
Kato et al.

(10) Patent No.: US 9,274,461 B2
(45) Date of Patent: Mar. 1, 2016

(54) TRANSFER DEVICE AND IMAGE FORMING APPARATUS INCORPORATING SAME

(71) Applicants: Tsutomu Kato, Kanagawa (JP); Hirokazu Ishii, Tokyo (JP); Takehide Mizutani, Kanagawa (JP); Shinya Tanaka, Kanagawa (JP); Yasufumi Takahashi, Kanagawa (JP); Osamu Ichihashi, Kanagawa (JP); Yuji Kato, Kanagawa (JP)

(72) Inventors: Tsutomu Kato, Kanagawa (JP); Hirokazu Ishii, Tokyo (JP); Takehide Mizutani, Kanagawa (JP); Shinya Tanaka, Kanagawa (JP); Yasufumi Takahashi, Kanagawa (JP); Osamu Ichihashi, Kanagawa (JP); Yuji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/254,192

(22) Filed: Apr. 16, 2014

(65) Prior Publication Data

US 2014/0314435 A1 Oct. 23, 2014

(30) Foreign Application Priority Data

Apr. 17, 2013 (JP) ..... 2013-086591

(51) Int. Cl.
*G03G 15/16* (2006.01)

(52) U.S. Cl.
CPC ..... *G03G 15/1675* (2013.01)

(58) Field of Classification Search
CPC ..... G03G 15/1605; G03G 15/1645; G03G 15/1665; G03G 15/1675; G03G 15/6535; G03G 2215/025; G03G 2215/1614; G03G 21/00
USPC ..... 399/45, 66, 121, 314
See application file for complete search history.

(56) References Cited

U.S. PATENT DOCUMENTS

| | | | | |
|---|---|---|---|---|
| 5,515,146 | A | 5/1996 | Harasawa et al. | |
| 5,631,725 | A | 5/1997 | Harasawa et al. | |
| 5,633,703 | A * | 5/1997 | Takenouchi | G03G 15/167 399/315 |
| 5,812,919 | A | 9/1998 | Takano et al. | |
| 5,822,667 | A | 10/1998 | Hayama et al. | |
| 5,930,573 | A | 7/1999 | Miyamoto et al. | |
| 6,188,862 | B1 | 2/2001 | Ishii | |
| 6,282,386 | B1 | 8/2001 | Ishii | |
| 2003/0035658 | A1 | 2/2003 | Ishii | |
| 2003/0219296 | A1 | 11/2003 | Kabata et al. | |
| 2004/0184824 | A1 * | 9/2004 | Hirai et al. | 399/21 |
| 2005/0169667 | A1 | 8/2005 | Katoh | |

(Continued)

FOREIGN PATENT DOCUMENTS

| | | |
|---|---|---|
| JP | 09-146381 | 6/1997 |
| JP | 2001-201954 | 7/2001 |

(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A transfer device includes a transfer member and a bias applicator. The transfer member contacts a surface, on which a toner image is borne, of an image bearing body, to form a transfer nip. The bias applicator applies a DC voltage and an AC voltage as transfer bias to transfer the toner image on the image bearing body to a recording sheet in the transfer nip. The bias applicator applies a DC voltage having a same polarity as the DC voltage of the transfer bias and an AC voltage having an amplitude smaller than the AC voltage of the transfer bias or applies the DC voltage having the same polarity as the DC voltage of the transfer bias without applying an AC voltage, when an inter-sheet area that exists on the image bearing body passes through the transfer nip during a continuous image formation period.

8 Claims, 11 Drawing Sheets

(56) References Cited

U.S. PATENT DOCUMENTS

| | | | | |
|---|---|---|---|---|
| 2005/0180767 | A1* | 8/2005 | Ishii et al. | 399/66 |
| 2006/0045570 | A1 | 3/2006 | Kato et al. | |
| 2006/0210307 | A1 | 9/2006 | Katoh et al. | |
| 2006/0210324 | A1 | 9/2006 | Kuma et al. | |
| 2006/0284958 | A1 | 12/2006 | Saeki et al. | |
| 2007/0003333 | A1 | 1/2007 | Ishii | |
| 2007/0014597 | A1 | 1/2007 | Ishii | |
| 2007/0098472 | A1 | 5/2007 | Saeki et al. | |
| 2007/0127941 | A1 | 6/2007 | Ishii et al. | |
| 2007/0127947 | A1 | 6/2007 | Kuma et al. | |
| 2007/0127955 | A1 | 6/2007 | Katoh et al. | |
| 2007/0248391 | A1 | 10/2007 | Yokokawa et al. | |
| 2007/0286640 | A1 | 12/2007 | Katoh et al. | |
| 2008/0175619 | A1 | 7/2008 | Katoh et al. | |
| 2009/0279906 | A1 | 11/2009 | Kuma et al. | |
| 2010/0008687 | A1 | 1/2010 | Ishii | |
| 2010/0142985 | A1 | 6/2010 | Minbe et al. | |
| 2010/0221029 | A1 | 9/2010 | Minbu et al. | |
| 2010/0272478 | A1 | 10/2010 | Ichihashi | |
| 2011/0064487 | A1 | 3/2011 | Ichihashi et al. | |
| 2011/0103862 | A1 | 5/2011 | Saeki et al. | |
| 2011/0158690 | A1 | 6/2011 | Mimbu et al. | |
| 2011/0206399 | A1 | 8/2011 | Fujita et al. | |
| 2011/0286759 | A1 | 11/2011 | Ichihashi et al. | |
| 2012/0034004 | A1 | 2/2012 | Ishii | |
| 2012/0045237 | A1* | 2/2012 | Aoki et al. | 399/66 |
| 2012/0121293 | A1 | 5/2012 | Mimbu et al. | |
| 2012/0148300 | A1 | 6/2012 | Katoh et al. | |
| 2012/0170951 | A1 | 7/2012 | Ishii | |
| 2012/0224879 | A1 | 9/2012 | Fujita et al. | |
| 2012/0230715 | A1 | 9/2012 | Ogino et al. | |
| 2012/0237233 | A1 | 9/2012 | Kato et al. | |
| 2012/0237234 | A1 | 9/2012 | Sugimoto et al. | |
| 2012/0237260 | A1 | 9/2012 | Sengoku et al. | |
| 2012/0237271 | A1 | 9/2012 | Sengoku et al. | |
| 2012/0328314 | A1 | 12/2012 | Sugimoto et al. | |
| 2012/0328321 | A1 | 12/2012 | Takeuchi et al. | |
| 2013/0064559 | A1 | 3/2013 | Nakamura et al. | |
| 2013/0089363 | A1 | 4/2013 | Mimbu et al. | |
| 2013/0114982 | A1 | 5/2013 | Ichihashi et al. | |
| 2013/0121714 | A1 | 5/2013 | Tanaka et al. | |
| 2013/0136468 | A1 | 5/2013 | Shimizu et al. | |
| 2013/0136477 | A1 | 5/2013 | Ogiyama et al. | |
| 2013/0142531 | A1 | 6/2013 | Sugimoto et al. | |
| 2013/0148993 | A1 | 6/2013 | Aoki et al. | |
| 2013/0164011 | A1 | 6/2013 | Nakamura et al. | |
| 2013/0177329 | A1 | 7/2013 | Tanaka et al. | |
| 2013/0177341 | A1 | 7/2013 | Saeki et al. | |
| 2013/0182269 | A1 | 7/2013 | Tanaka | |
| 2013/0189002 | A1 | 7/2013 | Ichihashi et al. | |
| 2013/0195483 | A1 | 8/2013 | Shimizu et al. | |
| 2013/0216281 | A1 | 8/2013 | Suzuki et al. | |
| 2013/0223901 | A1 | 8/2013 | Minbe et al. | |
| 2013/0236201 | A1 | 9/2013 | Mizutani et al. | |
| 2013/0243482 | A1 | 9/2013 | Kato et al. | |
| 2013/0308968 | A1 | 11/2013 | Tanaka et al. | |
| 2013/0322935 | A1 | 12/2013 | Ichihashi et al. | |
| 2014/0010562 | A1 | 1/2014 | Tanaka et al. | |
| 2014/0029988 | A1 | 1/2014 | Shimizu et al. | |
| 2014/0072340 | A1 | 3/2014 | Kato et al. | |
| 2014/0079418 | A1 | 3/2014 | Tanaka et al. | |

FOREIGN PATENT DOCUMENTS

| | | |
|---|---|---|
| JP | 2006-267486 | 10/2006 |
| JP | 2010-085822 | 4/2010 |
| JP | 2011-186168 | 9/2011 |
| JP | 2012-198303 | 10/2012 |

* cited by examiner

TRANSFER DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-086591, filed on Apr. 17, 2013, in the Japan Patent Office, the entire disclosure of which is hereby incorporated by reference herein.

BACKGROUND

1. Technical Field

Exemplary embodiments of this disclosure relate to a transfer device that transfers a toner image on a surface of an image bearing body to a recording material which is nipped in a transfer nip by contact between the image bearing body and a nip formation member, and an image forming apparatus incorporating the transfer device.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such an electrophotographic image forming apparatus may have a transfer device that transfers a toner image on the surface of an image bearing body to a recording material which is nipped in a transfer nip by contact between the image bearing body and a nip formation member.

For example, an image forming apparatus forms a toner image on the surface of a drum-like photoreceptor by a well-known electrophotographic process. An endless intermediate transfer belt that is provided in a transfer device and serves as an image bearing body is brought into contact with the photoreceptor, thereby forming a primary transfer nip. Then, in the primary transfer nip, the toner image on the photoreceptor is primarily transferred to the intermediate transfer belt.

A secondary transfer roller that is provided in the transfer device and serves as a transfer member is brought into contact with the intermediate transfer belt, thereby forming a secondary transfer nip. A secondary transfer opposed roller is disposed inside a loop of the intermediate transfer belt, and the intermediate transfer belt is nipped between this secondary transfer opposed roller and the secondary transfer roller.

While the secondary transfer roller outside the loop is connected to a ground, a power supply applies a secondary transfer bias to the secondary transfer roller inside the loop. Consequently, a secondary transfer electric field that allows the electrostatic movement of the toner image from the secondary transfer opposed roller side to the secondary transfer roller side is formed between the secondary transfer opposed roller and the secondary transfer roller.

Then, the toner image on the intermediate transfer belt is secondarily transferred to a recording sheet that is fed to the secondary transfer nip at the timing of synchronization with the toner image on the intermediate transfer belt, by the action of the secondary transfer electric field.

In such a configuration, when a sheet that is rich in surface irregularity, such as Japanese paper is used as a recording sheet, a gradation pattern copying the surface irregularity is easily generated in an image. Sufficient toner is not transferred to concave portions on the surface of the sheet, and the image density of the concave portions is thinner than that of convex portions, thereby causing this gradation pattern.

In the image forming apparatus, a DC power supply and an AC power supply are connected to each other, and the secondary transfer bias including a DC voltage and an AC voltage is applied. For the image forming apparatus, toner reciprocates between the surface concave portions of the recording material and the image bearing body by using such a secondary transfer bias, so that the toner can come into contact with the surface concave portions of the recording material. Consequently, it is possible to suppress the transfer failure of the toner to the surface concave portions of the recording material.

Additionally, it is known that the generation of the gradation pattern can be suppressed by the application of such a secondary transfer bias, compared to a case where a secondary transfer bias configured from only a DC voltage is applied.

As a result of study by the inventors of the present application, the inventors has found that a problem arises that the deterioration of a transfer member or the like, which is not generated by the secondary transfer bias that is configured from only a DC voltage and does not include an AC voltage, is generated, and the life of the member is shortened, in the case where a transfer bias that includes a DC voltage and an AC voltage is used as the secondary transfer bias.

BRIEF SUMMARY

In at least one exemplary embodiment of this disclosure, there is provided a transfer device including a transfer member and a bias applicator. The transfer member contacts a surface, on which a toner image is borne, of an image bearing body, to form a transfer nip. The bias applicator applies a direct current (DC) voltage and an alternating current (AC) voltage as transfer bias to transfer the toner image on the image bearing body to a recording sheet in the transfer nip. The bias applicator applies a DC voltage having a same polarity as the DC voltage of the transfer bias and an AC voltage having an amplitude smaller than the AC voltage of the transfer bias or applies the DC voltage having the same polarity as the DC voltage of the transfer bias without applying an AC voltage, when an inter-sheet area that exists on the image bearing body passes through the transfer nip during a continuous image formation period in which a plurality of recording sheets continuously pass through the transfer nipping area and images are formed on the plurality of recording sheets.

In at least one exemplary embodiment of this disclosure, there is provided an image forming apparatus including an image bearing body and a transfer device. The image bearing body has a surface to bear a toner image thereon. The transfer device transfers the toner image borne on the surface of the image bearing body, to a recording material nipped in a transfer nip. The transfer device includes a transfer member and a bias applicator. The transfer member contacts the surface of the image bearing body to form the transfer nip. The bias applicator applies a direct current (DC) voltage and an alternating current (AC) voltage as transfer bias to transfer the toner image on the image bearing body to the recording sheet in the transfer nip. The bias applicator applies a DC voltage having a same polarity as the DC voltage of the transfer bias and an AC voltage having an amplitude smaller than the AC voltage of the transfer bias or applies the DC voltage having the same polarity as the DC voltage of the transfer bias without applying an AC voltage, when an inter-sheet area that exists on the image bearing body passes through the transfer nip during a continuous image formation period in which a plurality of recording sheets continuously pass through the transfer nipping area and images are formed on the plurality of recording sheets.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
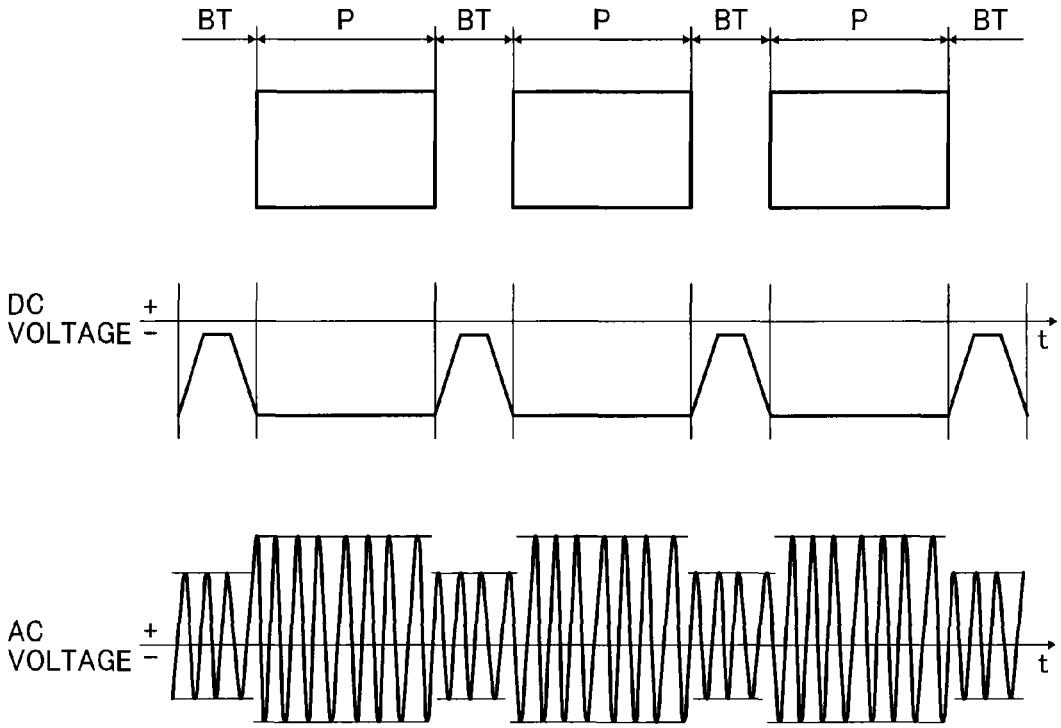
FIG. 1 is a diagram showing in a case of applying a bias including a DC voltage whose polarity is the same as that of the DC voltage of a secondary transfer bias, and whose absolute value is smaller than that of the DC voltage of the secondary transfer bias, and an AC voltage whose amplitude is smaller than that of the AC voltage of the secondary transfer bias, between sheets.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

As described above, as a result of study by the inventors of the present application, the inventors has found that a problem arises that the deterioration of a transfer member or the like, which is not generated by the secondary transfer bias that is configured from only a DC voltage and does not include an AC voltage, is generated, and the life of the member is shortened, in the case where a transfer bias that includes a DC voltage and an AC voltage is used as the secondary transfer bias.

Therefore, it is considered that when an inter-sheet area that exists on the image bearing body passes the transfer nip during a continuous image formation period when a plurality of recording sheets continuously pass and images are formed on the plurality of recording sheets, the secondary transfer bias is not applied to the secondary transfer roller. Consequently, the deterioration of the transfer member or the like can be suppressed compared to a case where the secondary transfer bias is continuously applied, also when the inter-sheet area passes the transfer nip during the continuous image formation period.

However, in the case where the DC power supply and the AC power supply are connected to each other, and a secondary transfer bias obtained by superimposing a DC voltage on an AC voltage is applied, the DC voltage is outputted via the base of the AC power supply. Therefore, the output responsiveness of the DC voltage is delayed due to the influence of a capacitor circuit in the base of the AC power supply, compared to a case where the DC voltage is outputted only by using the DC power supply.

Accordingly, even when the secondary transfer bias is applied at the timing when the leading edge of a recording sheet enters the transfer nip, from a state where no secondary transfer bias is applied, it is late that the secondary transfer bias reaches a predetermined potential, and transfer failure due to the shortage of the secondary transfer bias occurs at the leading edge of the recording sheet.

While a configuration, in which the secondary transfer bias is applied to the secondary transfer roller, and the secondary transfer opposed roller is connected to the ground, has been described, a problem similar to the aforementioned problem arises also in a configuration in which the secondary transfer bias is applied to the secondary transfer opposed roller, and the secondary transfer roller is connected to the ground.

In light of the above-described situation, at least one embodiment of the present disclosure provides a transfer device capable of suppressing deterioration of a transfer member or transfer failure also in the case where a transfer bias including a DC voltage and an AC voltage is used, and an image forming apparatus that include the transfer device.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

First Embodiment

Hereinafter, an image forming apparatus according to a first embodiment of the present disclosure is described below. In this embodiment, a printer is described as an example of the image forming apparatus that forms an image by an electrophotographic method.

Figure 2:
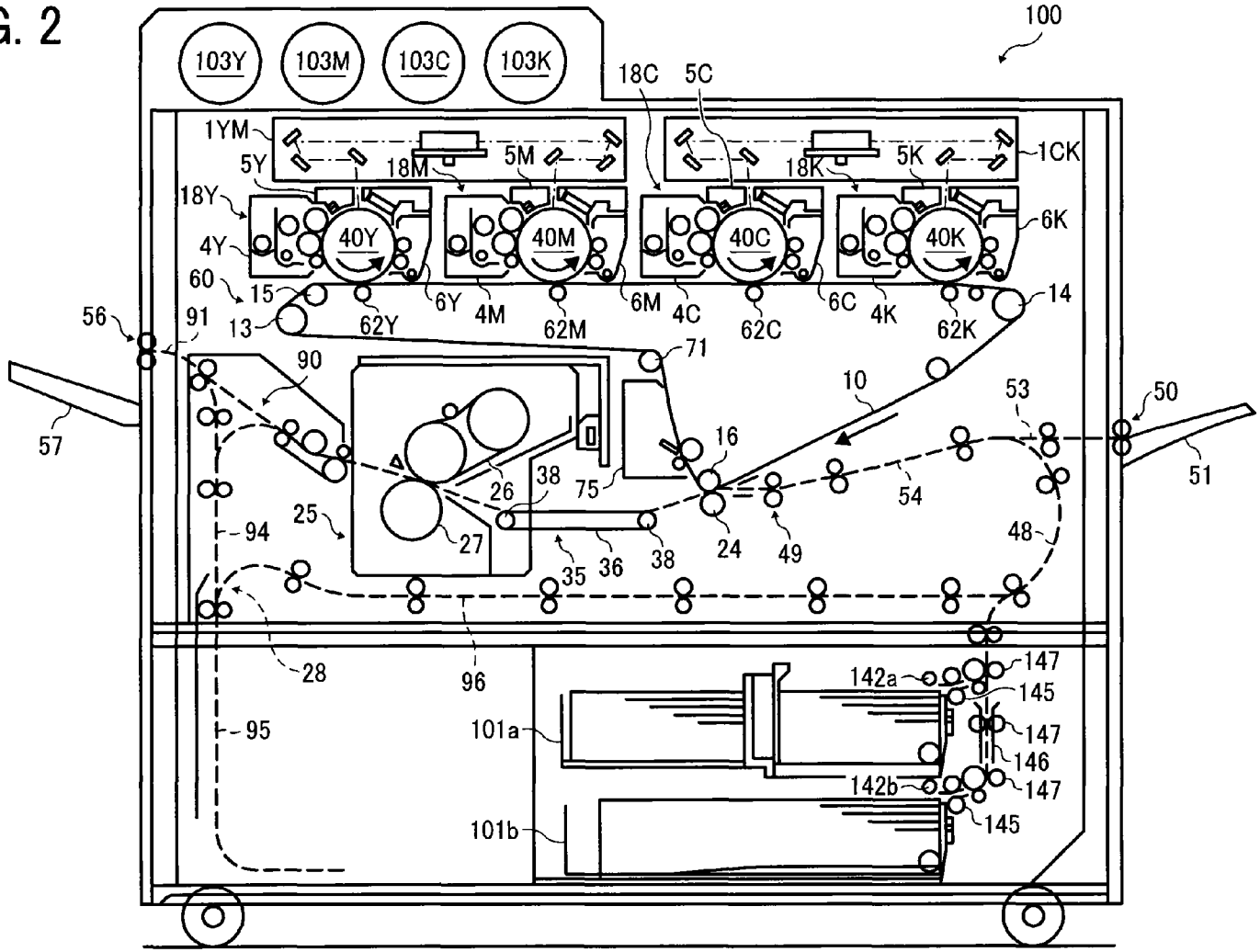
FIG. 2 is a schematic view of a configuration of a printer according to an embodiment of the present disclosure.

First, a basic configuration of the printer according to this embodiment will be described. FIG. 2 is a schematic view of a configuration of the printer according to this embodiment.

This printer includes two optical writing units 1YM and 1CK, four imaging units 18Y, 18M, 18C and 18K for forming toner images of Y, M, C and K, a sheet feed passage 48, a pre-transfer conveyance passage 54, a manual sheet feed passage 53, a manual feed tray 51, and the like. The printer further includes a pair of registration rollers 49, a conveyance belt unit 35, a fixing device 25, a conveyance switching device 90, a discharge passage 91, a pair of discharge rollers 56, a discharge tray 57, a first sheet feed cassette 101*a*, a second sheet feed cassette 101*b*, a resending device, and the like.

Each of the first sheet feed cassette 101*a* and the second sheet feed cassette 101*b* stores a bundle of recording sheets P as recording materials therein. The topmost recording sheets P in the bundles of sheets are delivered by the rotational driving of sheet feed rollers 142*a* and 142*b*, and separated by separation rollers 145*a* and 145*b* one by one to feed to a sheet feed passage 146. Then, the recording sheets P fed to the sheet feed passage 146 are conveyed by conveyance rollers 147 to be guided to the sheet feed passage 48 in a printer-section body 100.

This sheet feed passage 48 is followed by the pre-transfer conveyance passage 54 for conveying the recording sheet immediately before a secondary transfer nip, described later. The recording sheets P fed from the first sheet feed cassette 101*a* and the second sheet feed cassette 101*b* enter the pre-transfer conveyance passage 54 via the sheet feed passage 48.

The manual feed tray 51 is disposed on the side surface of a printer housing openably and closably with respect to the housing, and a bundle of sheets is manually loaded on the tray upper surface in an opened state with respect to the housing. The topmost recording sheet P in the manually inserted bundle of sheets is fed toward the pre-transfer conveyance passage 54 by a feed roller of the manual feed tray 51.

The two optical writing units 1YM and 1CK each have a laser diode, a polygon mirror, various lenses and the like. The two optical writing units 1YM and 1CK drive laser diodes on the basis of image information read by a scanner outside the printer, or image information transmitted from a personal computer, to optically scan photoreceptors 40Y, 40M, 40C and 40K of the imaging units 18Y, 18M, 18C and 18K.

Specifically, the photoreceptors 40Y, 40M, 40C and 40K of the imaging units 18Y, 18M, 18C and 18K are rotationally driven counterclockwise in FIG. 2 by driving units. The optical writing unit 1YM applies laser beams to the photoreceptors 40Y and 40M being driven, while deflecting the photoreceptors 40Y and 40M in rotation-axial directions, thereby performing optical scanning. Consequently, on the photoreceptors 40Y and 40M, respective electrostatic latent images based on Y image information and M image information are formed.

The optical writing unit 1CK applies laser beams to the photoreceptors 40C and 40K being driven, while deflecting photoreceptors 40C and 40K in rotation-axial directions, thereby performing optical scanning. Consequently, on the photoreceptors 40C and 40K, respective electrostatic latent images based on C image information and K image information are formed.

The imaging units 18Y, 18M, 18C and 18K have the drum-like photoreceptors 40Y, 40M, 40C and 40K that serve as latent image bearing bodies, respectively. Additionally, the imaging units 18Y, 18M, 18C and 18K support various devices disposed around the photoreceptors 40Y, 40M, 40C and 40K on a common supporting body as one unit, and are detachable with respect to the printer-section body.

The imaging units 18Y, 18M, 18C and 18K have similar configurations, except that the colors of toner to be used are different. In an example of the imaging unit 18Y for Y, the imaging unit 18Y has a development device 4Y for developing an electrostatic latent image, which is formed on the surface of the imaging unit 18Y, on a Y toner image, in addition to the photoreceptor 40Y. Additionally, the imaging unit 18Y has a charging device 5Y that applies a uniformly-charging process to the surface of the rotationally driven photoreceptor 40Y, a drum cleaning device 6Y that cleans residual toner after transfer that adheres to the surface of the photoreceptor 40Y which has passed through a primary transfer nip for Y described later, and the like The printer according to this embodiment is a tandem type printer in which the four imaging units 18Y, 18M, 18C and 18K are arranged along the endless moving direction of an intermediate transfer belt 10 with respect to the intermediate transfer belt 10 that is an endless belt described later.

As the photoreceptor 40Y, a drum-like photoreceptor configured by forming, on an element tube of aluminum or the like, a photosensitive layer coated with an organic photosensitive material having photosensitivity is used. However, an endless belt-like photoreceptor may be used.

The development device 4Y develops a latent image by using two-component developer (hereinafter, simply referred to as "developer") that contains magnetic carrier and non-magnetic Y toner. Y toner in a Y toner bottle 103Y is properly replenished to the development device 4Y by a yellow-toner replenishment device.

As the development device 4Y, a device that develops by one-component developer which does not contain magnetic carrier in place of the two-component developer may be used.

As the drum cleaning device 6Y, a device employing a system of pressing, against the photoreceptor 40Y, a cleaning blade that is a cleaning member and is made of polyurethane rubber may be used. However, devices employed other systems may be used. In the printer, a system of bringing a rotatable fur brush into contact with the photoreceptor 40Y is employed for the purpose of enhancing cleaning performance. The fur brush also serves as a role of scraping lubricant from solid lubricant to make fine powder while coating the lubricant on the surface of the photoreceptor 40Y.

A neutralization lamp is disposed above the photoreceptor 40Y, and forms a part of the imaging unit 18Y. The neutralization lamp neutralizes the surface of the photoreceptor 40Y that has passed through the drum cleaning device 6Y, by light application. The neutralized surface of the photoreceptor 40Y is uniformly charged by the charging device 5Y, and thereafter optically scanned by the aforementioned optical writing unit 1YM.

The charging device 5Y rotationally drives while receiving the supply of charging bias from a power supply. In place of such a system, a scorotron charger system of performing a charging process in non-contact with the photoreceptor 40Y may be employed.

The imaging unit 18Y for Y is described above, the imaging units 18M, 18C and 18K for M, C and K has the same configurations as the imaging unit 18Y for Y.

A transfer unit 60 is disposed below the four imaging units 18Y, 18M, 18C and 18K.

The transfer unit 60 is provided with an intermediate transfer belt 10 that is an endless belt which extends over a plurality of support rollers such as a driven roller 13, a drive roller 14, a driven roller 15, a secondary transfer opposed roller 16, and a tension roller 71. The intermediate transfer belt 10 is run (endlessly moved) clockwise in FIG. 2 by the rotational driving of the drive roller 14 while coming into contact with the photoreceptors 40Y, 40M, 40C and 40K. Consequently, primary transfer nips for Y, M, C and K where the photoreceptors 40Y, 40M, 40C and 40K come into contact with the intermediate transfer belt 10 are formed.

Primary transfer rollers 62Y, 62M, 62C and 62K that serve as primary transfer members are disposed in the vicinity of the primary transfer nips for Y, M, C and K inside a belt loop that is a space surrounded by the inner circumferential surface of the intermediate transfer belt 10. Then, the primary transfer rollers 62Y, 62M, 62C and 62K press the intermediate transfer belt 10 toward the photoreceptors 40Y, 40M, 40C and 40K, respectively.

Respective power supplies apply primary transfer biases to the primary transfer rollers 62Y, 62M, 62C and 62K. Consequently, primary transfer electric fields that allow the electrostatic movement of toner images on the photoreceptors 40Y, 40M, 40C and 40K toward the intermediate transfer belt 10 are formed on the primary transfer nips for Y, M, C and K.

The toner images are sequentially superimposed at the respective primary transfer nips, and the superimposed toner images are primarily transferred to the outer circumferential surface of the intermediate transfer belt 10 that sequentially passes through the primary transfer nips for Y, M, C and K accompanied by clockwise endless movement (in FIG. 2). A superimposed four colored toner image (hereinafter, referred to as "four-colored toner image") is formed on the outer circumferential surface of the intermediate transfer belt 10 by the primary transfer of superimposition.

A secondary transfer roller 24 is disposed below the intermediate transfer belt 10 in FIG. 2. The secondary transfer roller 24 comes into contact with a winding portion with respect to the secondary transfer opposed roller 16 in the intermediate transfer belt 10, from the outer circumferential surface of the belt, to form a secondary transfer nip. Consequently, a secondary transfer nip in which the outer circumferential surface of the intermediate transfer belt 10 comes into contact with the secondary transfer roller 24 is formed.

A secondary transfer bias including a DC voltage and an AC voltage is applied to the secondary transfer opposed roller 16 by a secondary transfer bias power supply 309 (see FIG. 7) configured by connecting the DC power supply and the AC power supply. On the other hand, the secondary transfer roller 24 outside the belt loop is grounded. Consequently, a secondary transfer electric field is formed in the secondary transfer nip. A controller 370 (see FIG. 7) controls the secondary transfer bias power supply 309.

The aforementioned pair of registration rollers 49 is disposed on the right of the secondary transfer nip in FIG. 2, and a recording sheet P that is nipped between the rollers is fed to the secondary transfer nip at the timing of synchronization with the four-colored toner image on the intermediate transfer belt 10.

In the secondary transfer nip, the four-colored toner image on the intermediate transfer belt 10 is collectively secondarily transferred to the recording sheet P due to the influence of the secondary transfer electric field or nip pressure, to become a full color image in combination with white of the recording sheet P.

Residual toner after transfer that is not transferred to the recording sheet P in the secondary transfer nip adheres to the outer circumferential surface of the intermediate transfer belt 10 that has passed through the secondary transfer nip. The residual toner after transfer is cleaned by a belt cleaning device 75 that comes into contact with the intermediate transfer belt 10.

The recording sheet P that has passed through the secondary transfer nip is separated from the intermediate transfer belt 10, to be delivered to the conveyance belt unit 35. The conveyance belt unit 35 allows an endless belt-like conveyance belt 36 to endlessly move counterclockwise in FIG. 2 by the rotational driving of a drive roller 37, while allowing the endless belt-like conveyance belt 36 to extend over the drive roller 37 and a driven roller 38.

The recording sheet P delivered from the secondary transfer nip is conveyed accompanied by the endless movement of the conveyance belt 36 while being held on the outer circumferential surface, on which the conveyance belt extends over, of the conveyance belt, and the recording sheet P is delivered to the fixing device 25 that serves as a fixing unit, has a fixing belt 26 and a pressure roller 27, and is heated by a heat source. Then, the image is fixed on the recording sheet P by heat and pressure with the fixing device 25.

In the printer, a refeeder is configured by the conveyance switching device 90, a refeed passage 94, a switch-back passage 95, a conveyance passage after switch back 96, and the like. Specifically, the conveyance switching device 90 switches the conveyance destination of the recording sheet P received from the fixing device 25 between the discharge passage 91 and the refeed passage 94.

When a print job of a one-sided printing mode for forming an image only on the first surface of the recording sheet P is performed, the conveyance destination of the recording sheet P is set to the discharge passage 91. Consequently, the recording sheet P formed with the image only on the first surface is sent to the pair of discharge rollers 56 via the discharge passage 91, to be discharged onto the discharge tray 57 outside the apparatus.

At the time of the execution of a print job of a duplex printing mode for forming an image on the both surfaces of the recording sheet P, also when the recording sheet P where the images are fixed on the both surfaces is received from the fixing device 25, the conveyance destination of the recording sheet P is set to the discharge passage 91. Consequently, the recording sheet P formed with the images on the both surfaces is discharged onto the discharge tray 57 outside the apparatus.

On the other hand, at the time of the execution of the print job of the duplex printing mode, when the recording sheet P where the image is fixed only on the first surface is received from the fixing device 25, the conveyance destination of the recording sheet P is set to the refeed passage 94 of a sheet reverse device 28.

The switch-back passage 95 is connected to the refeed passage 94, and the recording sheet P sent to the refeed passage 94 enters the switch-back passage 95. Then, when the entire areas in the conveyance direction of the recording sheet P enters the switch-back passage 95, the conveyance direction of the recording sheet P is reversed, and the recording sheet P is switched back.

The sheet reverse device 28 has the conveyance passage after switch back 96 in addition to the refeed passage 94, and the switch-back passage 95, and the recording sheet P that is switched back enters the conveyance passage after switch back 96. At this time, the recording sheet P is turned upside down. Then, the recording sheet P that is turned upside down is refed to the secondary transfer nip via the conveyance passage after switch back 96 and the sheet feed passage 48.

The recording sheet P, in which the toner image is transferred also to the second surface in the secondary transfer nip, passes through the fixing device 25 and the toner image is fixed on the second surface, and thereafter the recording sheet P is discharged onto the discharge tray 57 via the conveyance switching device 90, the discharge passage 91, and the pair of discharge rollers 56.

Figure 3:
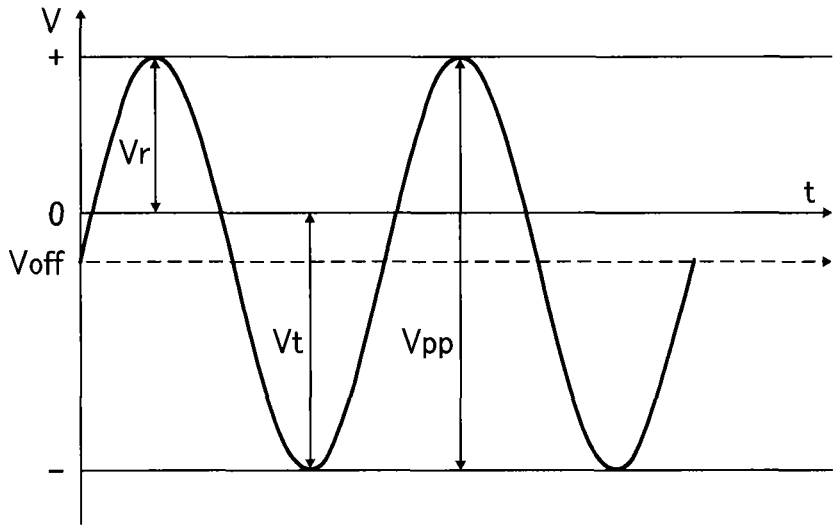
FIG. 3 is a waveform chart showing a waveform of a secondary transfer bias configured from a superimposed bias output from a secondary transfer bias power supply.

FIG. 3 is a waveform chart showing a waveform of a secondary transfer bias including a DC voltage and an AC voltage outputted from the secondary transfer bias power supply 309.

The secondary transfer bias is applied to a metal core of the secondary transfer opposed roller 16, and the secondary transfer bias power supply 309 functions as a bias applicator that applies a secondary transfer bias.

When the secondary transfer bias is applied to the metal core of the secondary transfer opposed roller 16, a potential difference is generated between the metal core of the secondary transfer opposed roller 16 and the metal core of the secondary transfer roller 24. Accordingly, the secondary transfer bias power supply 309 functions also as a potential difference generator.

The potential difference is generally treated as an absolute value, but is treated as a value with a polarity in the present embodiment. More specifically, a value obtained by deducting the potential of the metal core of the secondary transfer roller from the potential of the metal core of the secondary transfer opposed roller 16.

In a configuration where toner with a negative polarity is used as the toner, in the case where the time average value of the potential difference becomes negative, the potential of the secondary transfer roller 24 is made larger than the potential of the secondary transfer opposed roller 16 on a reverse polarity side to the charge polarity of the toner (positive side in this example). Accordingly, the toner is made to electrostatically move from the secondary transfer opposed roller side to the secondary transfer roller side.

In FIG. 3, an offset voltage Voff is a value of the DC voltage of the secondary transfer bias. A peak-to-peak voltage Vpp is a value of the AC voltage of the secondary transfer bias.

In the printer according to the present embodiment, the secondary transfer bias is a value obtained by superimposing the offset voltage Voff and the peak-to-peak voltage Vpp, and the time average value thereof becomes the same value as the offset voltage Voff.

In the printer according to the present embodiment, the secondary transfer bias is applied to the metal core of the secondary transfer opposed roller 16, and the metal core of the secondary transfer roller 24 is grounded (0 V). Accordingly, the potential of the metal core of the secondary transfer opposed roller 16 becomes a potential difference between the both metal cores with no change.

The potential difference between the both metal cores is configured from a DC voltage (Eoff) whose value is the same as that of the offset voltage Voff, and an AC voltage (Epp) whose value is the same as that of peak-to-peak voltage Vpp.

As shown in FIG. 3, in the printer according to the present embodiment, a voltage whose polarity is negative is employed as the offset voltage Voff. The polarity of the offset voltage Voff of the secondary transfer bias applied to the secondary transfer opposed roller 16 is made negative, so that the toner whose polarity is negative can be relatively pressed out from the secondary transfer opposed roller side to the secondary transfer roller side in the secondary transfer nip.

When the secondary transfer bias has a negative polarity which is the same as the polarity of the toner, the toner with a negative polarity is electrostatically pressed out from the secondary transfer opposed roller side to the secondary transfer roller side in the secondary transfer nip. Consequently, the toner on the intermediate transfer belt is transferred onto the recording sheet P.

On the other hand, when the secondary transfer bias has a positive polarity which is reverse to the polarity of the toner, the toner with a negative polarity is electrostatically attracted from the secondary transfer roller side to the secondary transfer opposed roller side in the secondary transfer nip. Consequently, the toner transferred to the recording sheet P is attracted to the intermediate transfer belt side again.

However, the time average value (the same value as the offset voltage Voff in this example) of the secondary transfer bias is a negative polarity, and therefore the toner is relatively electrostatically pressed out from the secondary transfer opposed roller side to the secondary transfer roller side.

The symbol "Vt" in FIG. 3 denotes a peak value of a voltage (feed voltage) with a polarity (negative polarity) in a direction in which the toner is transferred from the intermediate transfer belt 10 side to the recording sheet P side in the secondary transfer nip. The symbol "Vr" in FIG. 3 denotes a peak value of a voltage (return voltage) with a polarity (positive polarity) in a direction in which the toner is returned from the recording sheet P side to the intermediate transfer belt 10 side in the secondary transfer nip.

Figure 4:
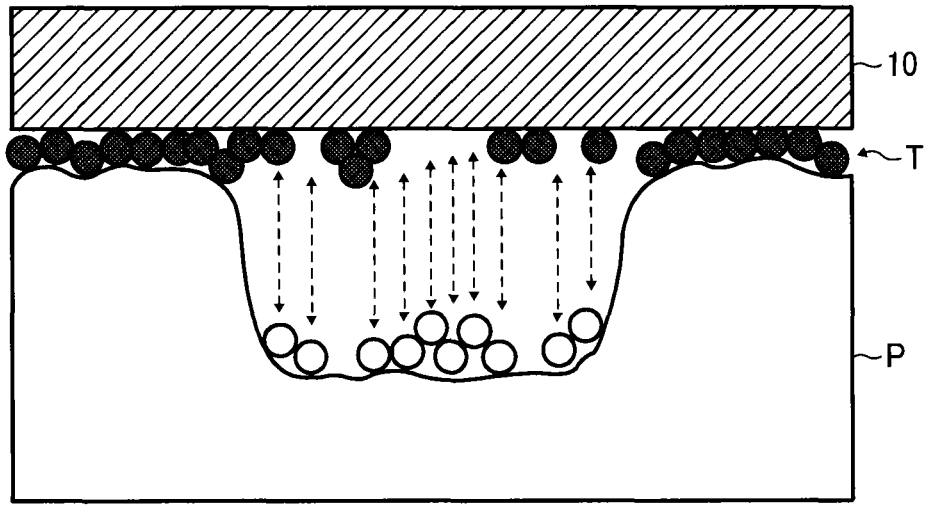
FIG. 4 is an explanatory drawing of an example of a principle of adhering toner to a recording sheet in the case where the secondary transfer bias power supply applies the superimposed bias to a secondary transfer opposed roller.

FIG. 4 is an explanatory drawing of an example of a principle of adhering toner to the recording sheet P in the case where the secondary transfer bias power supply 309 applies the secondary transfer bias to the secondary transfer opposed roller 16.

In the case where the secondary transfer bias is applied to the secondary transfer opposed roller 16, an AC waveform is produced, and therefore a voltage from the secondary transfer opposed roller 16 to the secondary transfer roller 24, and a voltage from the secondary transfer roller 24 to the secondary transfer opposed roller 16 are switched at predetermined cycles. As a result, toner T of the toner image formed on the intermediate transfer belt 10 starts to move in a direction toward the recording sheet P and a direction opposite to the direction. Additionally, when the voltage reaches a certain level of a voltage, the toner adheres to concave portions of the recording sheet P.

Figure 5A:
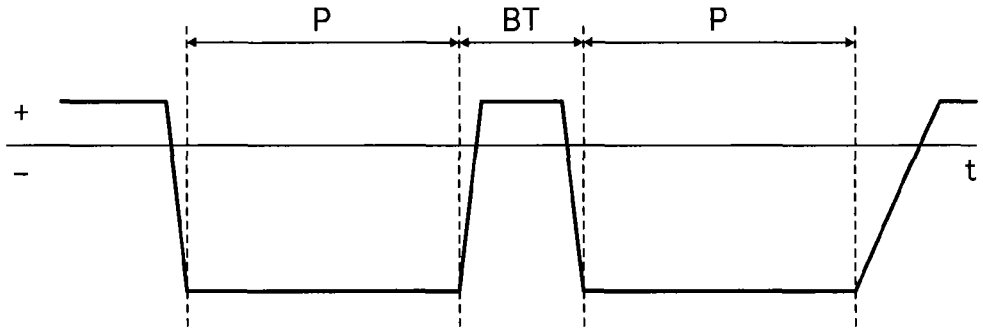
FIG. 5A is a diagram showing an output waveform of a DC voltage during a continuous image formation period in a case of using only a DC power supply.

FIG. 5A illustrates an output waveform of a DC voltage during a continuous image formation period in a case of using only a general DC power supply (power supply of only a DC voltage).

In this case, a DC voltage with a negative polarity is outputted as the secondary transfer bias, when the recording sheet P passes through the secondary transfer nip, and the toner image on the intermediate transfer belt 10 is transferred onto the recording sheet P, during the continuous image formation period. On the other hand, a DC voltage with a positive polarity is outputted as the secondary transfer bias between sheets where the recording sheet P does not yet pass through the secondary transfer nip.

Figure 5B:
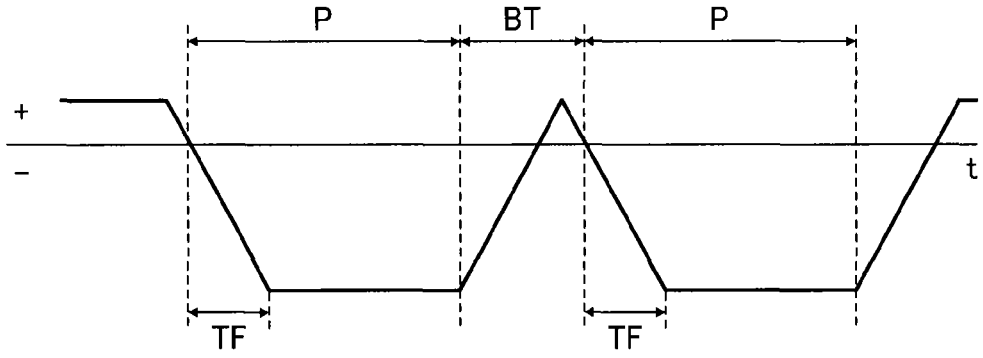
FIG. 5B is a diagram showing an output waveform of a DC voltage during a continuous image formation period in a case of connecting an AC power supply and the DC power supply.

FIG. 5B illustrates an output waveform of a DC voltage during a continuous image formation period in a case of connecting the AC power supply and the DC power supply in order to superimpose a DC voltage on an AC voltage.

In this case, the output responsiveness of the DC voltage is delayed, and therefore the secondary transfer bias does not reach a predetermined potential immediately as shown in FIG. 5B, even when the DC voltage is switched from the positive polarity to the negative polarity at the same timing as FIG. 5A. As a result, the secondary transfer bias is insufficient on the leading edge of a recording sheet P, and an abnormal image such as transfer failure TF is generated.

Thus, in the case where the AC power supply and the DC power supply are connected to each other, even when the AC voltage does not output and only the DC voltage outputs, the output response of the DC voltage is delayed as shown in FIG. 5B.

Figure 5C:
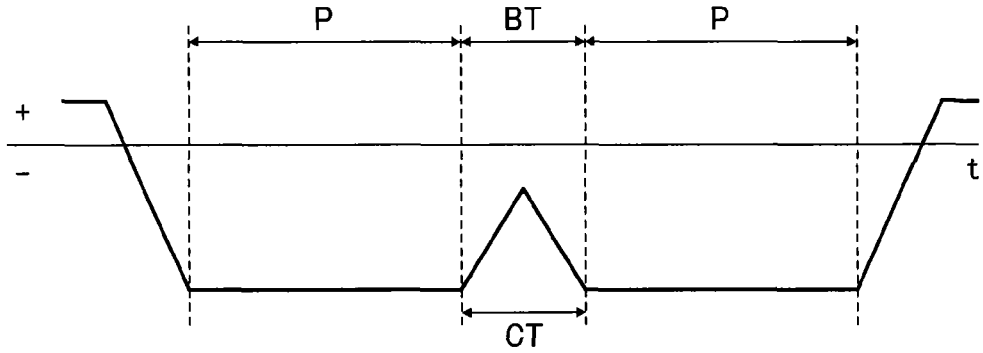
FIG. 5C is a diagram showing an output waveform of a DC voltage during a continuous image formation period in a case of connecting the AC power supply and the DC power supply to making the output timing of the secondary transfer bias earlier than the timing in FIG. 5B.

FIG. 5C illustrates an output waveform of a DC voltage during a continuous image formation period in a case of connecting the AC power supply and the DC power supply to make the output timing of the secondary transfer bias earlier than the timing in FIG. 5B.

As shown in FIG. 5C, the output timing of the secondary transfer bias is made earlier than the timing in FIG. 5B, so that the potential of the secondary transfer bias can reach a predetermined potential, when the leading edge of the recording sheet P enters the secondary transfer nip. Accordingly, the shortage of the secondary transfer bias on the leading edge of a recording sheet is suppressed, and the generation of an abnormal image such as transfer failure TF can be suppressed.

However, as seen from in FIG. 5C, the polarity of the DC voltage does not become positive in an area between sheets (inter-sheet area BT), and therefore background staining toner that adheres to an inter-sheet area BT on the intermediate transfer belt 10, and charged to a negative polarity is transferred to the secondary transfer roller 24 by electrostatic force. As a result, when the recording sheet P passes through the secondary transfer nip, the toner adhering to the secondary transfer roller 24 causes contamination CT, such as edge surface staining or rear surface staining on the recording sheet P.

In the printer of the present embodiment, image formation is performed by using the secondary transfer bias configured by superimposing an AC voltage on a DC voltage. However, in an inter-sheet area BT between sheets, an AC voltage whose amplitude is smaller than that of the AC voltage of the secondary transfer bias is applied or no AC voltage is applied.

FIG. 1 shows a case of applying a bias including a DC voltage whose polarity (negative polarity in the embodiment) is the same as that of the DC voltage of the secondary transfer bias and whose absolute value is smaller than that of the DC voltage of the secondary transfer bias, and an AC voltage whose amplitude is smaller than that of the AC voltage of the secondary transfer bias, between sheets.

Figure 6:
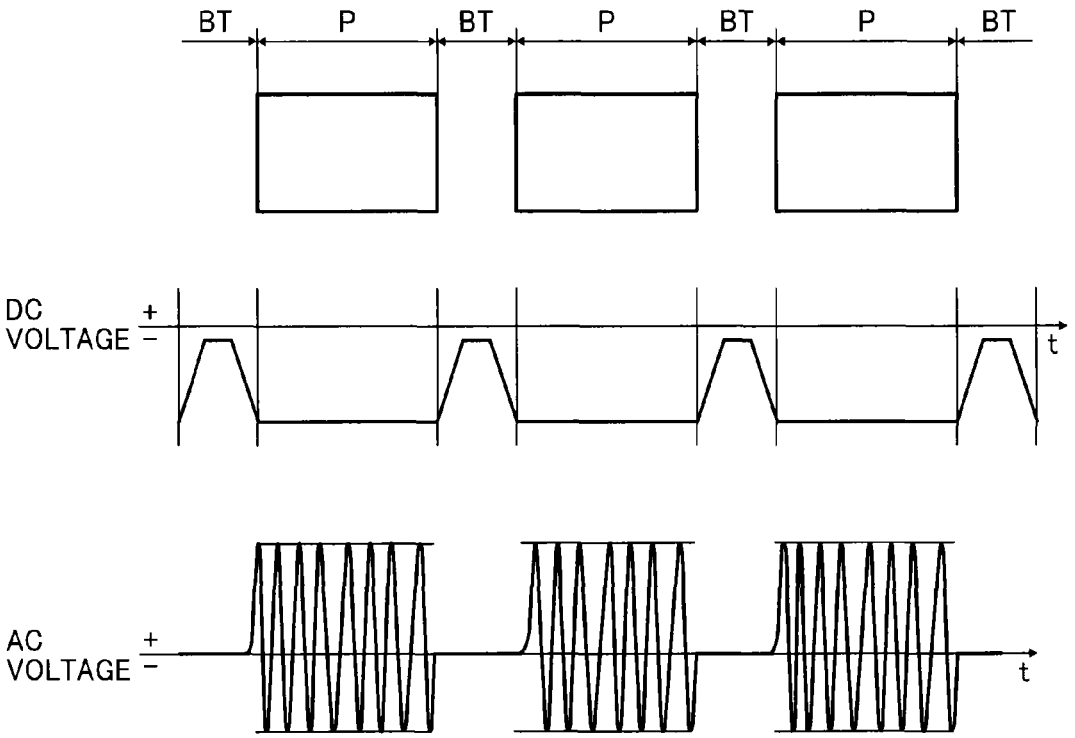
FIG. 6 is a diagram showing a case of applying a bias of a DC voltage whose polarity is the same as that of the DC voltage of the secondary transfer bias and whose absolute value is smaller than that of the DC voltage of the secondary transfer bias, and applying no AC voltage.

FIG. 6 shows a case of applying a bias of a DC voltage whose polarity (negative polarity in the embodiment) is the same as that of the DC voltage of the secondary transfer bias and whose absolute value is smaller than that of the DC voltage of the secondary transfer bias, and not applying a bias of an AC voltage (value is 0).

In FIG. 1 and FIG. 6, a DC voltage applied by the secondary transfer bias power supply 309 when an inter-sheet area BT passes through the secondary transfer nip has the same polarity (a negative polarity herein) as the DC voltage of the secondary transfer bias, and has an absolute value smaller than the DC voltage of the secondary transfer bias.

In this case, when the inter-sheet area BT passes through the secondary transfer nip after the recording sheet P passes through the secondary transfer nip, the delay of the output responsiveness of the DC voltage is reduced compared to change in the polarity of the DC voltage from a negative polarity to a positive polarity by the secondary transfer bias power supply 309. Therefore, the output responsiveness of the DC voltage is earlier compared to a case of the aforementioned change in the polarity of the DC voltage from a negative polarity to a positive polarity, and the potential of the DC voltage applied when the inter-sheet area BT passes through the secondary transfer nip is on the negative polarity side, and has an absolute value smaller than the DC voltage of the secondary transfer bias.

Accordingly, background staining toner adhering to the inter-sheet area BT on the intermediate transfer belt 10 is unlikely to be transferred to the secondary transfer roller 24, compared to the case of FIG. 5C, and edge surface staining or rear surface staining can be unlikely to occur on the recording sheet P.

The delay of the output responsiveness of the DC voltage at the time of applying the secondary transfer bias can be reduced, compared to a case of applying a DC voltage whose polarity is reversed to the polarity of the secondary transfer bias, or applying no DC voltage, when the inter-sheet area BT passes through the secondary transfer nip. Accordingly, the secondary transfer bias can promptly reach the predetermined potential from the application of the secondary transfer bias, and it is possible to suppress transfer failure caused by the shortage of the secondary transfer bias on the leading edge of a recording sheet.

Furthermore, as described above, a distance between sheets during the continuous image formation period can be reduced, compared to the case of applying the DC voltage whose polarity is reversed to the polarity of the secondary transfer bias, or applying no DC voltage, as described above. Hence, reduction in productivity can be suppressed.

Herein, in the case where an AC voltage equal to the secondary transfer bias is superimposed on the DC voltage applied to the secondary transfer opposed roller 16, when the inter-sheet area BT passes through the secondary transfer nip, a peak voltage value (absolute value) on the secondary transfer bias the same polarity side is increased. Therefore, background staining toner that adheres to the inter-sheet area BT on the intermediate transfer belt 10 and charged to a negative polarity may be transferred to the secondary transfer roller 24 due to the influence of this AC voltage, and the secondary transfer roller 24 may be stained with the toner.

On the contrary, in FIG. 1, when the inter-sheet area BT passes through the secondary transfer nip, the DC voltage described above, an AC voltage whose amplitude is smaller than the amplitude of the AC voltage of the secondary transfer bias is applied to the secondary transfer opposed roller 16. In FIG. 6, the AC voltage is not applied, and only the aforementioned DC voltage is applied to the secondary transfer opposed roller 16.

Consequently, the toner is unlikely to be transferred from the intermediate transfer belt 10 to the secondary transfer roller 24 between sheets, compared to a case of applying the AC voltage equal to the secondary transfer bias to the secondary transfer opposed roller 16 in addition to the DC voltage, when the inter-sheet area BT passes through the secondary transfer nip. Accordingly, the secondary transfer roller 24 can be inhibited from staining, and the edge surface or the rear surface of the recording sheet P can be prevented from staining with the toner adhering to the secondary transfer roller 24.

Additionally, the deterioration of the secondary transfer opposed roller 16, the intermediate transfer belt 10, the secondary transfer roller 24, or the like can be suppressed, compared to a case of continuing to apply the AC voltage equal to the AC voltage of the secondary transfer bias, also when the inter-sheet area BT passes through the secondary transfer nip, during the continuous image formation period. Accordingly, it is possible to suppress the shortening of the life of these members.

That is, in the printer of the present embodiment, image formation is performed by using the secondary transfer bias including the DC voltage and the AC voltage, during the continuous image formation period. On the other hand, when the inter-sheet area BT passes through the secondary transfer nip, the AC voltage is not applied. Alternatively, an AC voltage change period, during which the AC voltage whose amplitude is smaller than the amplitude of the AC voltage of the secondary transfer bias is applied, exists. Consequently, it is possible to suppress the acceleration of the deterioration of the transfer member or the like due to the AC voltage, and suppress the shortening of the life, compared to a configuration in which such an AC voltage change period is not provided when the inter-sheet area BT passes through the secondary transfer nip.

Figure 7:
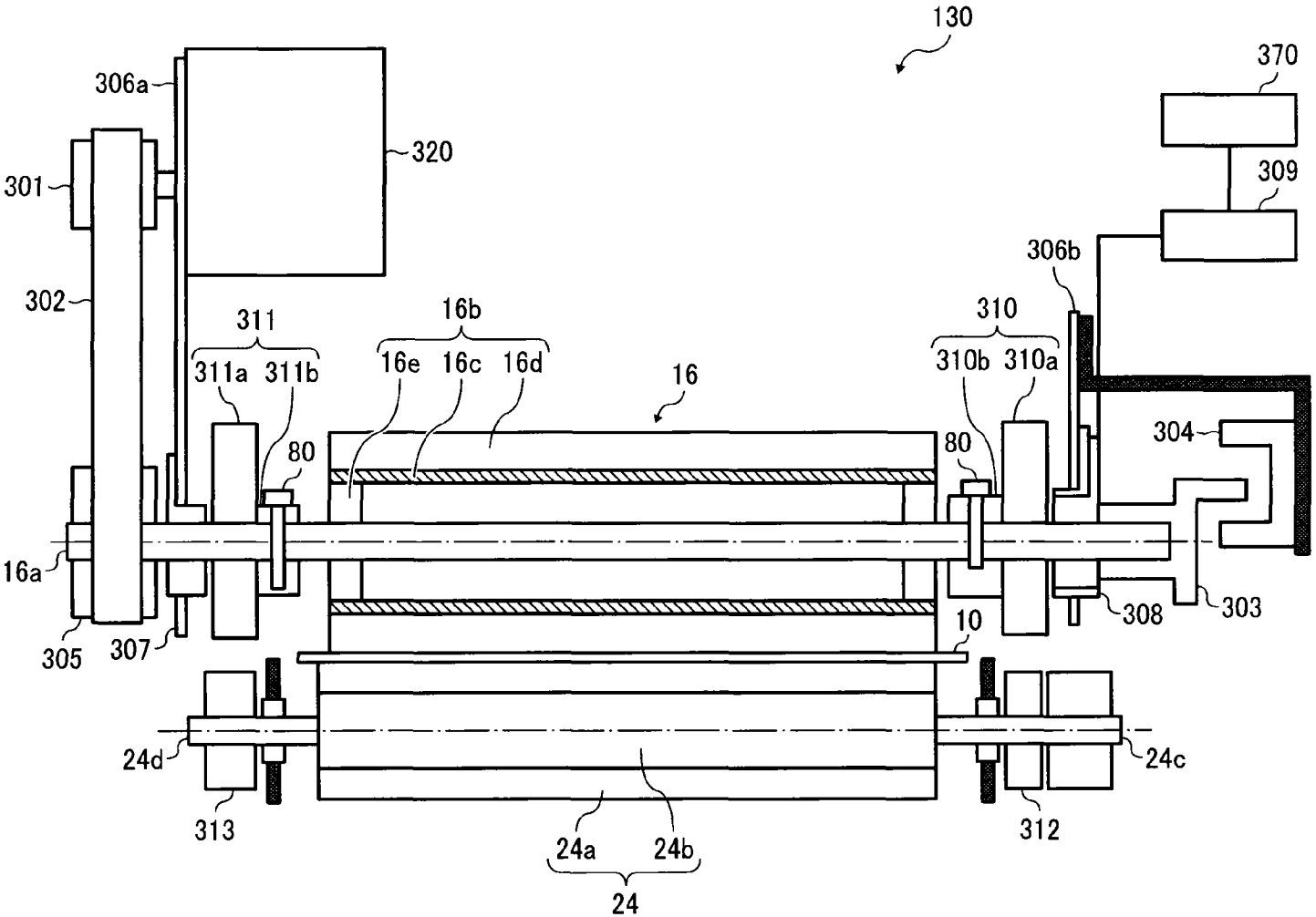
FIG. 7 is a schematic view of a configuration of a contact-and-separation assembly that makes a secondary transfer roller come into contact with and separate from an intermediate transfer belt.

FIG. 7 is a schematic view of a configuration of a contact-and-separation assembly 130 that is a contact-and-separation unit which makes the secondary transfer roller 24 come into contact with and separate from the intermediate transfer belt 10.

The secondary transfer roller 24 has a first shaft member 24*c* and a second shaft member 24*d* that protrude from both axial end surfaces, and extend in a rotation axial direction, and a first idling roller 312 and a second idling roller 313 which are described later. Additionally, the secondary transfer roller 24 includes a cylindrical hollow metal core 24*b*, and an elastic layer 24*a* that is configured from an elastic material and fixed to the circumferential surface of the cylindrical hollow metal core 24*b*.

As the metal that configures the hollow metal core 24*b*, stainless steel, aluminum, or the like can be exemplified, the metal is not limited to these materials.

The elastic layer 24*a* is desirably JIS-A hardness of 70° or less. In the case where a cleaning blade is brought into contact with the secondary transfer roller 24, when the soft elastic layer 24*a* is too soft, various failures are caused. Accordingly, the elastic layer 24*a* is desirably JIS-A hardness of 40° or more.

In the case where the secondary transfer roller 24 does not have cleaning function, the elastic layer 24*a* can be softened, and an abnormal image resulting from an impact generated when the recording sheet P rushes into and escapes the secondary transfer nip can be reduced by the softening. Accordingly, the elastic layer 24*a* is desirably Asker-D hardness of about 40 to 50°.

For the elastic layer 24*a* of the secondary transfer roller 24, conductive epichlorohydrin rubber, Si rubber or EPDM configured by dispersing carbon, NBR having an ion conductive function, polyurethane rubber, or the like may be used as a rubber material that exhibits conductivity.

The elastic layer 24*a* fixed on the circumferential surface of the hollow metal core 24*b* is configured from a conductive rubber material whose resistance is adjusted so as to exert resistance of about 7.5 Log Ω.

The reason why the electric resistance of the elastic layer 24*a* is adjusted to a predetermined range is as follows. This is because a transfer current is prevented from concentrating on a portion where a belt and a roller are in direct contact with each other without the recording sheet P interposed therebetween in the secondary transfer nip, when the recording sheet P whose size in a roller axial direction is relatively small, such as A5 size, is used. The electric resistance of the elastic layer 24*a* is made larger than the resistance of the recording sheet P, thereby enabling the suppression of such transfer current concentration.

As the conductive rubber material that configures the elastic layer 24*a*, foamed rubber is used so as to exert elasticity of Asker-C hardness of about 40 to 50°. The elastic layer 24*a* is configured from such foamed rubber, so that the elastic layer 24*a* is deformed in a thickness direction in the secondary transfer nip, and the secondary transfer nip having a certain degree of extent in a sheet conveyance direction can be formed.

The elastic layer 24*a* is formed in a drum shape in which the outer diameter of a central portion is larger than the outer diameter of an end. The elastic layer 24*a* is formed in such a drum shape, so that pressure on the central portion is prevented from releasing due to the occurrence of deflection, when the secondary transfer roller 24 is urged toward the intermediate transfer belt 10 to form a nip by the urging coil spring 351 (see FIG. 8).

The secondary transfer roller 24 with such a configuration is urged toward the intermediate transfer belt 10 wound around the secondary transfer opposed roller 16.

The secondary transfer opposed roller 16 wound around the intermediate transfer belt 10 has a roller 16*b* that is a cylindrical body, and a through shaft member 16*a* that idles the roller 16*b* on the surface of the through shaft member 16*a* while penetrating in a rotation axial direction with respect to the rotation central portion of the roller 16*b*.

The through shaft member 16*a* is made of metal, and freely idles the roller 16*b* on the circumferential surface thereof. The roller 16*b* as a body includes a drum-like hollow metal core 16*c*, an elastic layer 16*d* that is made of an elastic material and is fixed on the circumferential surface of the hollow metal core 16*c*, and a ball bearing 16*e* pressed in the both axial ends of the hollow metal core 16*c*.

Then, the ball bearing 16*e* rotates on the through shaft member 16*a* along with the hollow metal core 16*c*, while supporting the hollow metal core 16*c*. The elastic layer 16*d* is formed on the outer circumferential surface of the hollow metal core 16*c*.

The shaft member 16*a* is rotatably supported by a first bearing 308 fixed to a first side plate 306*b* of the transfer unit 60 in which the intermediate transfer belt 10 extends over, and a second bearing 307 fixed to a second side plate 306*a*.

However, the shaft member 16*a* does not rotationally drive and stops in most of the time in a print job. Then, the shaft member 16*a* freely idles the roller 16*b*, which tries to co-rotate accompanied by the endless movement of the intermediate transfer belt 10, on the circumferential surface of the shaft member 16*a*.

The elastic layer 16*d* fixed on the circumferential surface of the hollow metal core 16*c* is configured from an EP rubber material whose resistance is 6.0 Log Ω or less. As the rubber material that configures the elastic layer 16*d*, EP rubber is used so as to exert elasticity of JIS-A hardness of about 70°.

In the through shaft member 16*a* of the secondary transfer opposed roller 16, cams that each serve as an abutting member for abutting on the secondary transfer roller 24 are provided on both end areas, in which roller 16*b* is not located, in the longitudinal entire area. Then, the cams are fixed so as to rotate integrally with the through shaft member 16*a*.

Specifically, a first cam 310 is fixed to one end of the longitudinal area of the through shaft member 16*a*. In the first cam 310, a cam 310*a* and a perfect circular roller 310*b* are axially arranged to be integrally formed with each other. A pin 80 arranged in the roller 310*b* penetrates the through shaft member 16*a*, so that the first cam 310 is fixed to the through shaft member 16*a*. Additionally, a second cam 311 having a configuration similar to that of the first cam 310 is fixed to the other end of the longitudinal area of the through shaft member 16*a*.

A drive receiving pulley 305 is fixed to an area outside the second cam 311 in the axial direction of the through shaft member 16*a*. Additionally, a detected disk 303 is fixed to an area outside the first cam 310 in the axial direction of the through shaft member 16*a*.

On the other hand, a cam driving motor 320 is fixed to the second side plate 306*a* of the transfer unit 60, a motor pulley 301 on a shaft of the cam driving motor 320 is rotated, and driving force is transmitted to the drive receiving pulley 305 fixed to the through shaft member 16*a*, via a timing belt 302.

With the aforementioned configuration, it is possible to rotate the through shaft member 16*a* by driving the cam driving motor 320. At this time, it is possible to freely idle the roller 16*b* on the through shaft member 16*a* even when the through shaft member 16*a* is rotated, and therefore the co-rotation of the roller 16*b* due to the belt is not hindered, A stepping motor is used as the cam driving motor 320, so that a motor rotation angle can be freely set without providing a rotation-angle detector such as an encoder.

When the through shaft member 16*a* stops rotation at a predetermined rotation angle, respective convex portions of the cams 310*a* and 311*a* of the first cam 310 and the second cam 311 abut on the first idling roller 312 and the second idling roller 313 arranged on a shaft of the secondary transfer roller 24. Consequently, the secondary transfer roller 24 is pressed back against the urging force of the urging coil spring 351 of a swinging member 350.

Consequently, the secondary transfer roller 24 moves in a direction away from the secondary transfer opposed roller 16 (also the intermediate transfer belt 10), so that a distance between shafts of the secondary transfer opposed roller 16 and the secondary transfer roller 24 is adjusted.

In such a configuration, a distance adjuster that adjusts the distance between the secondary transfer opposed roller 16 and the secondary transfer roller 24 is configured by the first cam 310, the second cam 311, the cam driving motor 320, the swinging member 350, and the like.

The secondary transfer opposed roller 16 that serves as a rotatable support rotating body freely idles the roller 16*b* on the through shaft member 16*a* that penetrates the cylindrical roller 16*b*.

When the through shaft member 16*a* rotates, the cams 310 and 311 fixed to the respective both axial ends of the through shaft member 16*a* rotate integrally. Therefore, the drive transmission assembly for transmitting driving to the through shaft member 16*a* is provided on only one of the axial ends, so that the cams on the both sides can be rotated.

In this printer, while hollow metal core 24*b* of the secondary transfer roller 24 is grounded, the secondary transfer bias whose polarity is the same as that of the toner is applied to the hollow metal core 16*c* of the secondary transfer opposed roller 16. Consequently, the secondary transfer electric field that allows the toner to electrostatically move from the secondary transfer opposed roller 16 side to the secondary transfer roller 24 side is formed between the both rollers in the secondary transfer nip.

The first bearing 308 that rotatably receives the metal through shaft member 16*a* of the secondary transfer opposed roller 16 is configured from a conductivity slide bearing. The secondary transfer bias power supply 309 that outputs the secondary transfer bias is connected to the conductive first bearing 308.

The secondary transfer bias outputted from the secondary transfer bias power supply 309 is guided to the secondary transfer opposed roller 16 via the conductive first bearing 308. Then, in the secondary transfer opposed roller 16, the secondary transfer bias is transmitted to the metal through shaft member 16*a*, the metal ball bearing 16*e*, the metal hollow metal core 16*c*, and the conductive elastic layer 16*d* in this order.

The detected disk 303 fixed to the end of the through shaft member 16*a* has a detected part 303*a* that axially rises at a predetermined position in the rotation direction of the through shaft member 16*a*.

On the other hand, an optical sensor 304 is fixed to a sensor bracket fixed to the first side plate 306*b* of the transfer unit 60.

In the course of the rotation of the through shaft member 16*a*, when the through shaft member 16*a* is positioned in a predetermined rotation angle range, the detected part 303*a* of the detected disk 303 enters between a light emitting element and a light receiving element of the optical sensor 304 to block an optical path.

When receiving light from the light emitting element, the light receiving element of the optical sensor 304 transmits a light reception signal to the controller 370. The controller 370 grasps the cam rotation angular position of the cams 310 and 311 fixed to the through shaft member 16*a*, on the basis of the timing when the light reception signal from the light receiving element stops, or the driving amount of the cam driving motor 320 from the timing.

As described above, the cams 310 and 311 abut on the first idling roller 312 and the second idling roller 313 arranged on the shaft of the secondary transfer roller 24 at the predetermined rotation angle, respectively. Then, the secondary transfer roller 24 is pressed back in the direction away from the secondary transfer opposed roller 16 against the urging force of the urging coil spring 351 (hereinafter, this press back is referred to as "press down").

The press-back amount (hereinafter, referred to as press-down amount) at this time is determined by the rotation angular positions of the cams 310 and 311. The larger the press-down amount of the secondary transfer roller 24 is, the larger the distance between the secondary transfer opposed roller 16 and the secondary transfer roller 24 is.

The first idling roller 312 is provided in the first shaft member 24*c* of the secondary transfer roller 24 to be capable of idling. The first idling roller 312 is a ball bearing whose outer diameter is slightly smaller than that of the secondary transfer roller 24, and can idle on the circumferential surface of the first shaft member 24*c*. The second idling roller 313 that has the same configuration as the first idling roller 312 is provided in the second shaft member 24*d* of the secondary transfer roller 24 to be capable of idling.

As described above, in the secondary transfer opposed roller 16, the cams 310 and 311 fixed to the through shaft member 16*a* abut on the idling rollers 312 and 313 at predetermined rotation angular positions, respectively.

Specifically, the first cam 310 fixed to the one of the ends of the through shaft member 16*a* abuts on the first idling roller 312 of the secondary transfer roller 24. At this time, the second cam 311 fixed to the other of the ends of the through shaft member 16*a* simultaneously abuts on the second idling roller 313 of the secondary transfer roller 24.

The rotation of the idling rollers 312 and 313 on which the cams 310 and 311 of the secondary transfer opposed roller 16 is hindered by this abutting. However, this does not prevent the rotation of the secondary transfer roller 24.

This is because even when the idling rollers 312 and 313 stop rotating, the idling roller acts as ball bearings, and shaft members 24*c* and 24*d* of the secondary transfer roller 24 can be independent of the idling rollers to freely rotate.

The rotation of the idling rollers 312 and 313 stops accompanied by the abutting of the cams 310 and 311, so that occurrence of the rubbing of the both can be avoided and the rising of torque of a belt driving motor or the driving motor of the secondary transfer roller 24 due to the rubbing can be avoided.

In the printer of the present embodiment, when the recording sheet P whose thickness is, for example, 127 g/m$^2$ or more (hereinafter, referred to as cardboard) passes, contact-and-separation operation between the intermediate transfer belt 10 and the secondary transfer roller 24 is performed.

In addition to this, also in the case where toner patch that adjusts toner density, or the discharge pattern of toner is drawn between sheets on the intermediate transfer belt 10 during printing operation, or the like, the contact-and-separation operation between the intermediate transfer belt 10 and the secondary transfer roller 24 is performed between sheets.

Figure 8:
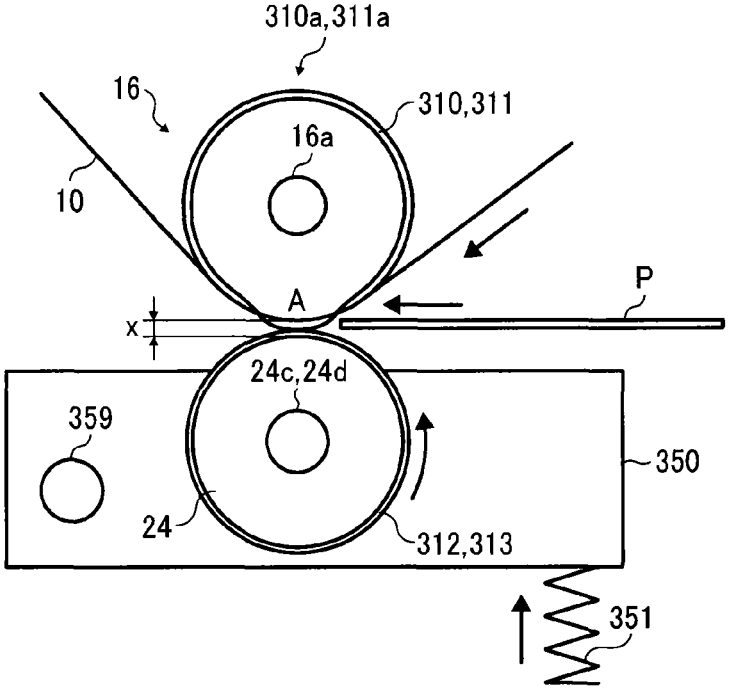
FIG. 8 is a diagram showing a state where secondary transfer roller and the intermediate transfer belt are separated from each other by a contact-and-separation assembly, when a cardboard enters the secondary transfer nip.
Figure 9:
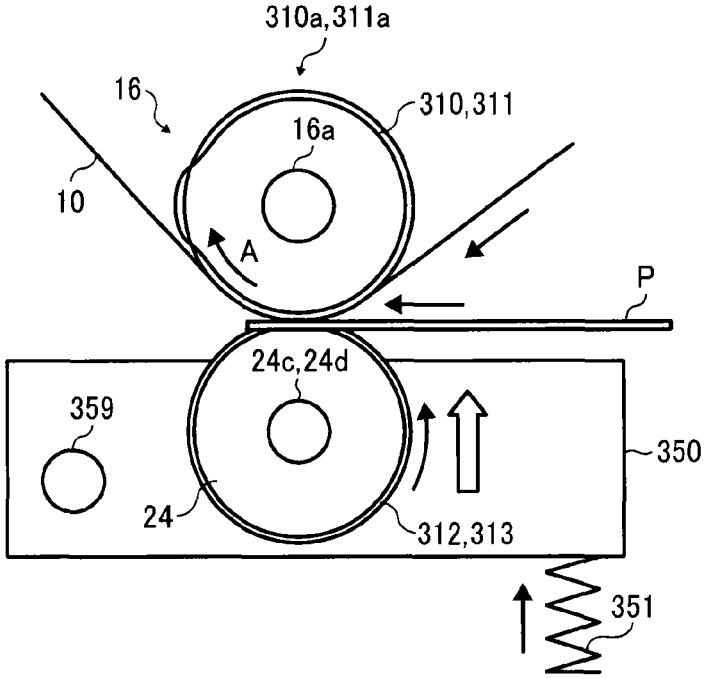
FIG. 9 is a diagram showing a state where the secondary transfer roller and the intermediate transfer belt are brought into contact with each other via the cardboard by the contact-and-separation assembly, when the cardboard passes through the secondary transfer nip.
Figure 10:
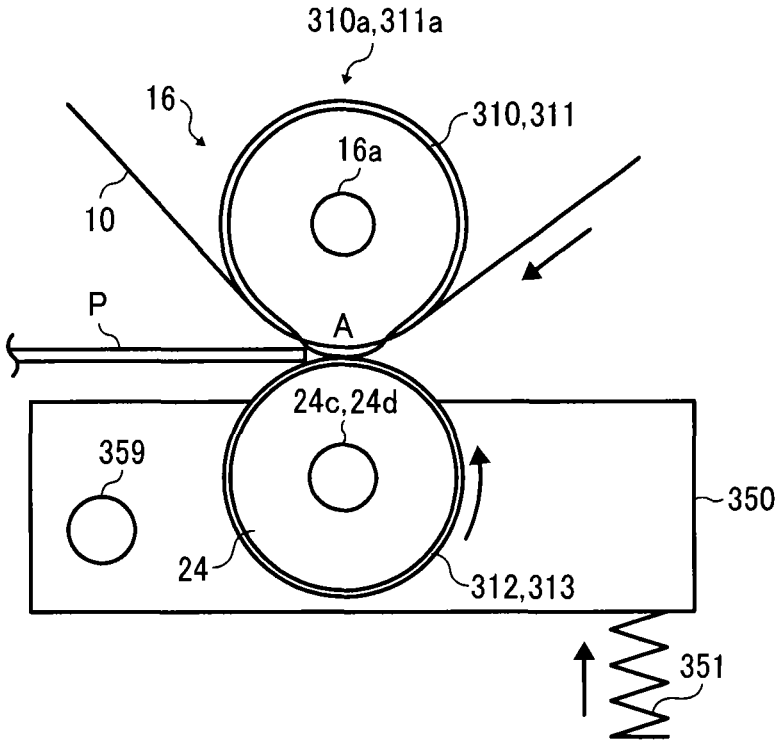
FIG. 10 is a diagram showing a state where the secondary transfer roller and the intermediate transfer belt are separated from each other by the contact-and-separation assembly, when the cardboard gets out of the secondary transfer nip.

FIG. 8 shows a state where the secondary transfer roller 24 and the intermediate transfer belt 10 are separated from each other by the contact-and-separation assembly 130 when the cardboard enters the secondary transfer nip. FIG. 9 shows a state where the secondary transfer roller 24 and the intermediate transfer belt 10 are brought into contact with each other via the cardboard by the contact-and-separation assembly 130, when the cardboard passes through the secondary transfer nip. FIG. 10 shows a state where the secondary transfer roller 24 and the intermediate transfer belt 10 are separated from each other by the contact-and-separation assembly 130, when the cardboard gets out of the secondary transfer nip.

In the printer of the present embodiment, the shaft members 24*c* and 24*d* of the secondary transfer roller 24 are rotatably supported by the swinging member 350 that is swingable with respect to the apparatus body about the swinging shaft 359. The urging coil spring 351 that urges the swinging member 350 upward in FIG. 8 is provided on the lower surface of the swinging member 350 such that the secondary transfer roller 24 is pressed toward the secondary transfer opposed roller 16.

Then, when the cardboard enters the secondary transfer nip, the rotation of the through shaft member 16*a* of the secondary transfer opposed roller 16 is stopped at a position where the convex portions A of the cams 310*a* and 311*a* of the cams 310 and 311 abut on the idling rollers 312 and 313, as shown in FIG. 8.

That is, when the recording sheet P enters the secondary transfer nip, the secondary transfer roller 24 is pressed down by the cams 310 and 311, thereby forming a clearance having a distance X between the secondary transfer roller 24 and the intermediate transfer belt 10.

Thus, the clearance having the distance X is formed between the secondary transfer roller 24 and the intermediate transfer belt 10, so that it is possible to suppress the occurrence of a large load variation to the intermediate transfer belt 10 or the secondary transfer roller 24 at the time of entering of the secondary transfer nip, even when the cardboard enters.

On the other hand, when the cardboard passes in a state where the secondary transfer roller 24 is pressed down, nip pressure that is sufficient for transferring a toner image from the intermediate transfer belt 10 to the cardboard in the secondary transfer nip is not obtained, and the transferring properties of the toner image is lowered. Particularly, in the recording sheet P that has poor surface smoothness, reduction in transfer ratio is remarkably seen.

Therefore, immediately after the cardboard enters the secondary transfer nip, the through shaft member 16*a* of the secondary transfer opposed roller 16 is rotated such that the convex portions A of the cams 310*a* and 311*a* of the cams 310 and 311 do not abut on the idling rollers 312 and 313, respectively, as shown in FIG. 9. That is, the cams 310 and 311 are rotated clockwise or counterclockwise in FIG. 9, the cams 310 and 311 are stopped at positions where the cams 310 and 311 do not come into contact with the idling rollers 312 and 313, respectively.

Then, during the image transfer from the intermediate transfer belt 10 to the recording sheet P, the convex portions A of the cams 310*a* and 311*a* of the cams 310 and 311 are held at the positions where the convex portions A do not come into contact with the idling rollers 312 and 313 of the secondary transfer roller 24. Consequently, it is possible to suppress reduction in nip pressure in the secondary transfer nip, and suppress reduction in the transferring properties of the toner image from the intermediate transfer belt 10 to the cardboard.

When the cardboard gets out of the secondary transfer nip, the through shaft member 16*a* of the secondary transfer opposed roller 16 is rotated and stopped such that the convex portions A of the cams 310*a* and 311*a* of the cams 310 and 311 are located at the position where the convex portions abut on the idling rollers 312 and 313, as shown in FIG. 10.

That is, when the cardboard gets out of the secondary transfer nip, the secondary transfer roller 24 is pressed down by the cams 310 and 311, and the clearance having the distance X is formed between the secondary transfer roller 24 and the intermediate transfer belt 10.

Thus, the clearance having the distance X between the secondary transfer roller 24 and the intermediate transfer belt 10 is formed, so that it is possible to suppress the occurrence of a large load variation to the intermediate transfer belt 10 or the secondary transfer roller 24 at the time of the cardboard getting out of the secondary transfer nip.

Additionally, the contact-and-separation operation between the secondary transfer roller 24 and the intermediate transfer belt 10 is performed between sheets, so that background staining toner between sheets on the intermediate transfer belt 10 is inhibited from coming into contact with the secondary transfer roller 24 and adhering to the secondary transfer roller 24. Accordingly, it is possible to suppress edge surface staining or rear surface staining of the recording sheet P, which may be generated by the adherence of the toner to the secondary transfer roller 24.

The contact-and-separation operation between the secondary transfer roller 24 and the intermediate transfer belt 10 is performed similarly also when toner patch that adjusts toner density, or the discharge pattern of toner is drawn between sheets on the intermediate transfer belt 10 during printing operation.

At this time, the distance X of the clearance formed between the secondary transfer roller 24 and the secondary transfer opposed roller 16 may be set to such a distance that the toner patch or the discharge pattern on the intermediate transfer belt 10 does not come into contact with the secondary transfer roller 24.

Consequently, the toner patch or the discharge pattern formed between sheets on the intermediate transfer belt 10 can be inhibited from coming into contact with the secondary transfer roller 24, and toner can be inhibited from staining on the surface of the secondary transfer roller.

Additionally, in the printer of the present embodiment, the output control of the transfer bias can be switched between constant current output control and constant voltage output control. Then, when the secondary transfer bias at the time of transferring the toner image on the intermediate transfer belt 10 to the recording sheet P is outputted by the constant current control, and a bias applied between sheets is outputted by the constant voltage control.

When the secondary transfer roller 24 and the intermediate transfer belt 10 are brought into contact with each other, and the toner image is transferred to the recording sheet P from the intermediate transfer belt 10, a constant amount of a transfer current is required. Therefore, in the printer of the present embodiment, the secondary transfer bias is outputted by the constant current control such that a transfer field is kept constant even when the resistance of secondary transfer roller 24, or the recording sheet P is changed.

On the other hand, when the secondary transfer roller 24 and the intermediate transfer belt 10 are separated from each other, a current is unlikely to flow, or does not flow, due to the separation between the secondary transfer roller 24 and the intermediate transfer belt 10. Therefore, when the secondary transfer bias applied between the secondary transfer roller 24 and the intermediate transfer belt 10 that are separated is controlled at a constant current, a voltage is greatly increased in order that a predetermined current flows. Consequently, a current leaks to another place, thereby possibly causing the disturbance of an image or damage to the apparatus.

Therefore, in the printer of the embodiment, a bias applied between the separated secondary transfer roller 24 and the intermediate transfer belt 10 between sheets is controlled at a constant voltage. Consequently, it is possible to suppress defects resulting from abnormal rise of a voltage, as described above.

Second Embodiment

Hereinafter, an image forming apparatus according to a second embodiment of the present disclosure is described below. In this embodiment, a tandem type color copier (hereinafter, simply referred to as a copier) is described as an example of the image forming apparatus that forms an image by an electrophotographic method.

Figure 11:
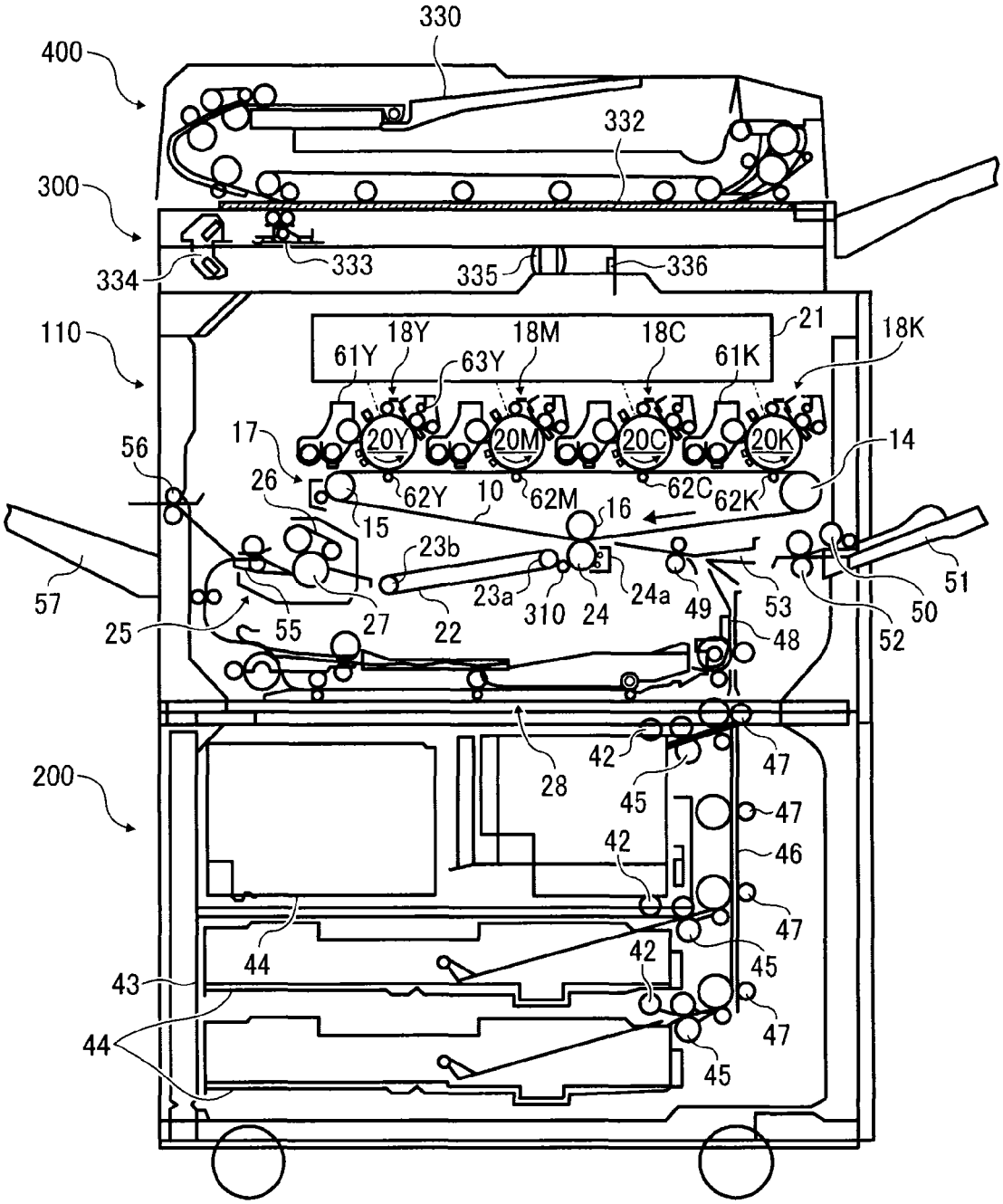
FIG. 11 is a schematic view of a configuration of a copier according to another embodiment of this disclosure.

FIG. 11 is a schematic view of a configuration of the copier according to this embodiment. A printer section 110 includes an endless belt-like intermediate transfer belt 10 that serves as an intermediate transfer body. The intermediate transfer belt 10 is wound around a drive roller 14, a driven roller 15, and a secondary transfer opposed roller 16 so as to be formed in an inverted triangle in side view, and is endlessly moved clockwise in FIG. 11 by rotational driving of the drive roller 14.

Four imaging units 18Y, 18M, 18C and 18K for forming toner images of Y (yellow), M (magenta), C (cyan) and K (black) are disposed above the intermediate transfer belt 10 so as to align along a belt moving direction.

The imaging units 18Y, 18M, 18C and 18K have photoreceptors 20Y, 20M, 20C and 20K, development devices 61Y, 61M, 61C and 61K, and photoreceptor cleaning devices 63Y, 63M, 63C and 63K, respectively.

The photoreceptors 20Y, 20M, 20C and 20K are rotationally driven counterclockwise in FIG. 11 by driving units, while coming into contact with the intermediate transfer belt 10 to form respective primary transfer nips for Y, M, C and K.

The development devices 61Y, 61M, 61C and 61K develop electrostatic latent images formed by the photoreceptors 20Y, 20M, 20C and 20K by Y, M, C and K toners, respectively.

Additionally, the photoreceptor cleaning devices 63Y, 63M, 63C and 63K clean residual toners after transfer adhering to the photoreceptors 20Y, 20M, 20C and 20K that have passed through the respective primary transfer nips.

In this copier, the four imaging units 18Y, 18M, 18C and 18K aligned along the belt moving direction configure a tandem image forming section.

In the printer section 110, an optical writing unit 21 is disposed above the tandem image forming section. The optical writing unit 21 applies optical writing processes by optical scanning to the surfaces of the photoreceptors 20Y, 20M, 20C and 20K rotationally driven counterclockwise in FIG. 11, to form the electrostatic latent images.

The surfaces of the photoreceptors 20Y, 20M, 20C and 20K are uniformly charged by uniform chargers of the imaging units 18Y, 18M, 18C and 18K, prior to respective optical writing processes.

The transfer unit including the intermediate transfer belt 10 and the like has primary transfer rollers 62Y, 62M, 62C and 62K inside a loop of the intermediate transfer belt 10. These primary transfer rollers 62Y, 62M, 62C and 62K presses the intermediate transfer belt 10 toward the photoreceptors 20Y, 20M, 20C and 20K on the rear sides of the primary transfer nips for Y, M, C and K.

A secondary transfer roller 24 is disposed below the intermediate transfer belt 10. The secondary transfer roller 24 comes into contact with a winding portion with respect to the secondary transfer opposed roller 16 in the intermediate transfer belt 10, from a front surface of the belt, to form a secondary transfer nip. A sheet-like recording medium (hereinafter, referred to as a recording sheet P) is fed into the secondary transfer nip at predetermined timing. Then, superimposed four colored toner image on the intermediate transfer belt 10 is collectively secondarily transferred to the recording sheet P in the secondary transfer nip.

A scanner section 300 causes a reading sensor 336 to read the image information of a document placed on an exposure glass 332, and feeds the read image information to a controller of the printer section 110. The controller controls a light source such as a laser diode and an LED in the optical writing unit 21 of the printer section 110, on the basis of the image information received from the scanner section 300. Then, writing laser beams for Y, M, C and K are emitted, and the photoreceptors 20Y, 20M, 20C and 20K are optically scanned. Respective electrostatic latent images are formed on the photoreceptors 20Y, 20M, 20C and 20K by the optical scanning, and the latent images are developed to be toner images for Y, M, C and K through a predetermined developing process.

The sheet feed section 200 includes sheet feed rollers 42 that feed the recording sheet P from sheet feed cassettes 44 disposed in multi-stages in a paper bank 43, separation rollers 45 that separate and guide the recording sheet P to a sheet feed passage 46, conveyance rollers 47 that convey the recording sheet P to a sheet feed passage 48 of the printer section 110, and the like.

As to sheet feeding, manual sheet feeding is possible in addition to the sheet feed section 200, and a manual feed tray 51 for manual sheet feeding, and a separation roller 52 that separates recording sheets P on the manual feed tray 51 one by one toward a manual sheet feed passage 53 are further provided. In the printer section 110, the manual sheet feed passage 53 joins the sheet feed passage 48.

In the vicinity of the end of the sheet feed passage 48, a pair of registration rollers 49 is disposed. The pair of registration rollers 49 nips the recording sheet P, which is conveyed on the sheet feed passage 48, between the rollers, and thereafter feeds the recording sheet P toward the secondary transfer nip at predetermined timing.

In the copier according to the embodiment, when a color image is copied, a document is set on a document mount 330 of an auto document feeder (ADF) 400, or the ADF 400 is opened, a document is set on an exposure glass 332 of the scanner section 300, and the ADF 400 is closed, thereby pressing the document. Thereafter, a start switch is pressed. Then, the document is conveyed onto the exposure glass 332, in the case where the document is set on the ADF 400.

Thereafter, the scanner section 300 starts driving, and a first traveling body 333 and the second travelling body 334 start traveling along a document surface. Then, light emitted from the light source in the first traveling body 333 is reflected on the document surface, and the obtained reflected light folded back toward the second travelling body 334. The folded light is further folded back by a mirror of the second travelling body 334, and thereafter incident upon the reading sensor 336 through an imaging lens 335. Consequently, document contents are read.

When receiving the image information from the scanner section 300, the printer section 110 feeds the recording sheet P having size according to the image information, to the sheet feed passage 48. Additionally, the drive roller 14 is rotationally driven by a driving motor accompanied by this, and the intermediate transfer belt 10 is endlessly moved clockwise in FIG. 11.

At the same time, after starting the rotational driving of the photoreceptors 20Y, 20M, 20C and 20K of the imaging units 18Y, 18M, 18C and 18K, a uniformly-charging process, an optical writing process, a developing process, and the like are applied to the photoreceptors 20Y, 20M, 20C and 20K.

The Y, M, C and K toner images formed on the surfaces of the photoreceptors 20Y, 20M, 20C and 20K by these processes are sequentially superimposed on the primary transfer nips for Y, M, C and K, and primarily transferred onto the intermediate transfer belt 10, to become a superimposed four-colored toner image.

In the sheet feed section 200, one of the sheet feed rollers 42 is selectively rotated in accordance with the size of the recording sheet P, and the recording sheet P is fed from one of the three sheet feed cassettes 44. The fed recording sheet P is separated by the separation roller 45 one by one to be guided to the sheet feed passage 46, and thereafter fed to the sheet feed passage 48 in the printer section 110 via the conveyance rollers 47.

In a case of using the manual feed tray 51, the sheet feed roller of the manual feed tray 51 rotationally drives, and the recording sheet P on the manual feed tray 51 is fed to the manual sheet feed passage 53 while being separated by the separation roller 52, and reaches the end of the sheet feed passage 48.

In the vicinity of the end of the sheet feed passage 48, the leading edge of the recording sheet P abuts on the pair of registration rollers 49 to stop. Thereafter, when the pair of registration rollers 49 rotationally drives at the timing of synchronization with the superimposed four-colored toner image on the intermediate transfer belt 10, the recording sheet is fed in the secondary transfer nip, and adheres to the superimposed four-colored toner image. Then, the superimposed four-colored toner image is collectively secondarily transferred onto the recording sheet P by the influence of nip pressure, a transfer field, or the like.

The recording sheet P, to which the superimposed four-colored toner image is secondarily transferred in the secondary transfer nip is fed into a fixing device 25 by a recording sheet conveyance belt 22. When the recording sheet P is nipped in the nip between a pressure roller 27 and a fixing belt 26 by the fixing device 25, the superimposed four-colored toner image is fixed on the surface of the recording sheet P, by press or heating treatment. Thus, the recording sheet P formed with a color image is stacked on a discharge tray 57 outside the apparatus via a pair of discharge rollers 56.

In the case where an image is formed on another surface of the recording sheet P, the recording sheet P is discharged from the fixing device 25, and thereafter fed to the sheet reverse device 28 by route switching by a switching claw 55. Then, after being turned upside down, the recording sheet P is returned to the pair of registration rollers 49 again, and goes through the secondary transfer nip and the fixing device 25 again.

After the recording sheet P passes through the secondary transfer nip, a belt cleaning device 17 is in contact with the surface of the intermediate transfer belt 10 before entering of the primary transfer nip for Y, in which the primary transfer is the most upstream among the four color.

In the copier of the present embodiment, a secondary transfer bias including a DC voltage and an AC voltage is applied to a metal core of the secondary transfer opposed roller 16 from a secondary transfer bias power supply 309 (see FIG. 7) that connects a DC power supply and an AC power supply to each other, similarly to the printer according to the first embodiment. Additionally, the metal core of the secondary transfer roller 24 is grounded. A secondary transfer bias applied to the secondary transfer opposed roller 16 from the secondary transfer bias power supply is similar to the secondary transfer bias described in the first embodiment with reference to FIG. 3, and therefore description thereof is omitted.

A principle of adhering toner to the recording sheet P in the case where the secondary transfer bias is applied to the secondary transfer opposed roller 16 by the secondary transfer bias power supply 309 in the copier of the present embodiment is similar to the principle described in the first embodiment with reference to FIG. 4, and therefore description thereof is omitted.

Herein, in the copier of the present embodiment, similarly to the first embodiment described with reference to FIG. 1 or FIG. 6, image formation is performed by using the secondary transfer bias including a DC voltage on an AC voltage during a continuous image formation period. On the other hand, when an inter-sheet area passes through the transfer nip, the AC voltage is not applied. Alternatively, an AC voltage change period, during which the AC voltage whose amplitude is smaller than the amplitude of the AC voltage of the secondary transfer bias, exists. Consequently, it is possible to suppress the acceleration of the deterioration of the secondary transfer opposed roller 16, the intermediate transfer belt 10, the secondary transfer roller 24 or the like due to the AC voltage, and suppress the shortening of the life, compared to a configuration in which such an AC voltage change period is not provided when the inter-sheet area passes through the secondary transfer nip.

A DC voltage applied by the secondary transfer bias power supply 309 when an inter-sheet area passes through the secondary transfer nip is set so as to have the same polarity (a negative polarity herein) as the DC voltage of the secondary transfer bias, and have an absolute value smaller than the DC voltage of the secondary transfer bias. Consequently, the output responsiveness of the DC voltage is earlier compared to a case of change in the polarity of the DC voltage from a negative polarity to a positive polarity as described above, and the potential of the DC voltage applied when the inter-sheet area passes through the secondary transfer nip is on the negative polarity side, and has an absolute value smaller than the DC voltage of the secondary transfer bias. Accordingly, background staining toner adhering to the inter-sheet area on the intermediate transfer belt 10 is unlikely to be transferred to the secondary transfer roller 24, and edge surface staining or rear surface staining can be unlikely to occur on the recording sheet P.

The delay of the output responsiveness of the DC voltage at the time of applying the secondary transfer can be reduced, compared to a case of applying a DC voltage whose polarity is reversed to the polarity of the secondary transfer bias, or applying no DC voltage, when the inter-sheet area passes through the secondary transfer nip. Accordingly, the secondary transfer bias can promptly reach a predetermined potential from the application of the secondary transfer bias, and it is possible to suppress transfer failure caused by the shortage of the secondary transfer bias on the leading edge of a recording sheet.

Furthermore, a distance between sheets during the continuous image formation period can be reduced, and reduction in productivity can be suppressed, compared to the case of applying the DC voltage whose polarity is reversed to the polarity of the secondary transfer bias, or applying no DC voltage, as described above.

Configurations, operation, and the like as to contact-and-separation operation between the secondary transfer roller 24 and the intermediate transfer belt 10 in the copier of the present embodiment are similar to those described in the first embodiment with reference to FIG. 7, and therefore description thereof is omitted.

In the copier of the present embodiment, the controller determines depending on the thickness of the recording sheet P whether or not a contact-and-separation assembly 130 (see FIG. 7) performs the contact-and-separation operation between the intermediate transfer belt 10 and the secondary transfer roller 24. When the recording sheet P whose thickness is, for example, 127 g/m$^2$ or more (hereinafter, referred to as cardboard) passes, the contact-and-separation assembly 130 performs the contact-and-separation operation between the intermediate transfer belt 10 and the secondary transfer roller 24.

In addition to this, also in the case where toner patch that adjusts toner density, or the discharge pattern of toner is drawn between sheets on the intermediate transfer belt 10 during printing operation, or the like, the contact-and-separation operation between the intermediate transfer belt 10 and the secondary transfer roller 24 is performed between sheets.

Figure 12:
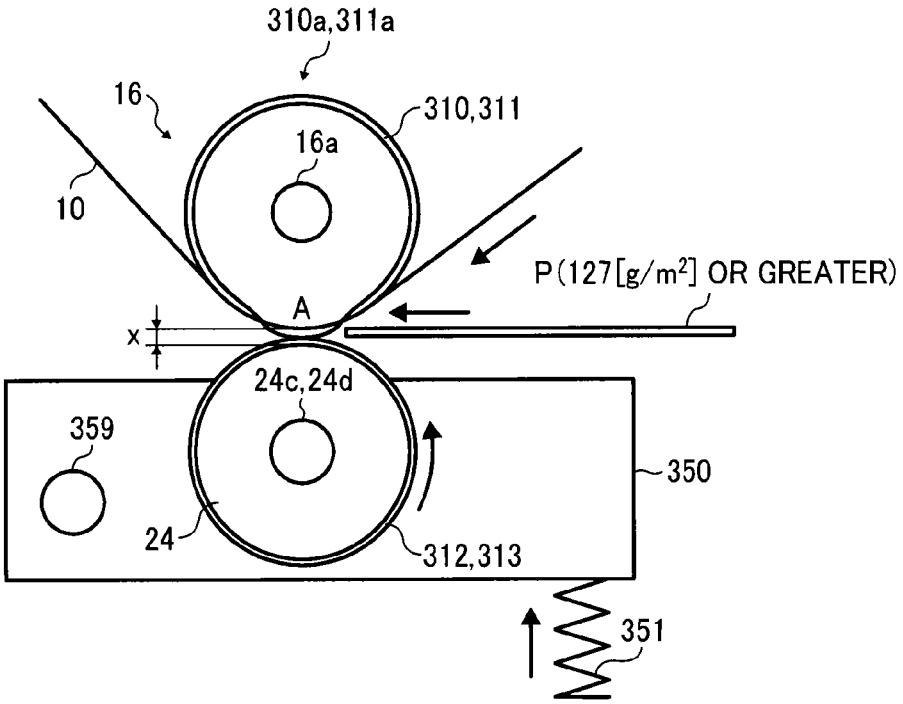
FIG. 12 is a diagram showing a state where a secondary transfer roller and an intermediate transfer belt are separated from each other by a contact-and-separation assembly, when a cardboard which is a recording sheet having a thickness of 127 g/m$^2$ or more enters a secondary transfer nip.

FIG. 12 shows a state where the secondary transfer roller 24 and the intermediate transfer belt 10 are separated from each other by the contact-and-separation assembly 130, when the cardboard which is a recording sheet P having a thickness of 127 g/m$^2$ or more enters the secondary transfer nip.

Figure 13:
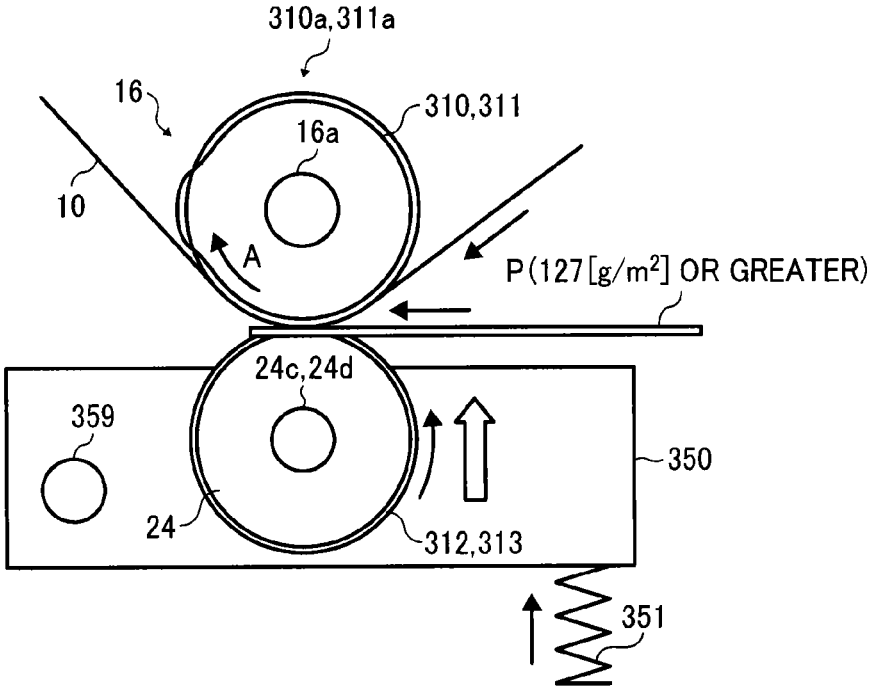
FIG. 13 is a diagram showing a state where the secondary transfer roller and the intermediate transfer belt are brought into contact with each other via the cardboard by the contact-and-separation assembly, when the cardboard which is a recording sheet having a thickness of 127 g/m$^2$ or more enters the secondary transfer nip.

FIG. 13 shows a state where the secondary transfer roller 24 and the intermediate transfer belt 10 are brought into contact with each other via the cardboard by the contact-and-separation assembly 130, when the cardboard which is a recording sheet P having a thickness of 127 g/m$^2$ or more enters the secondary transfer nip.

Figure 14:
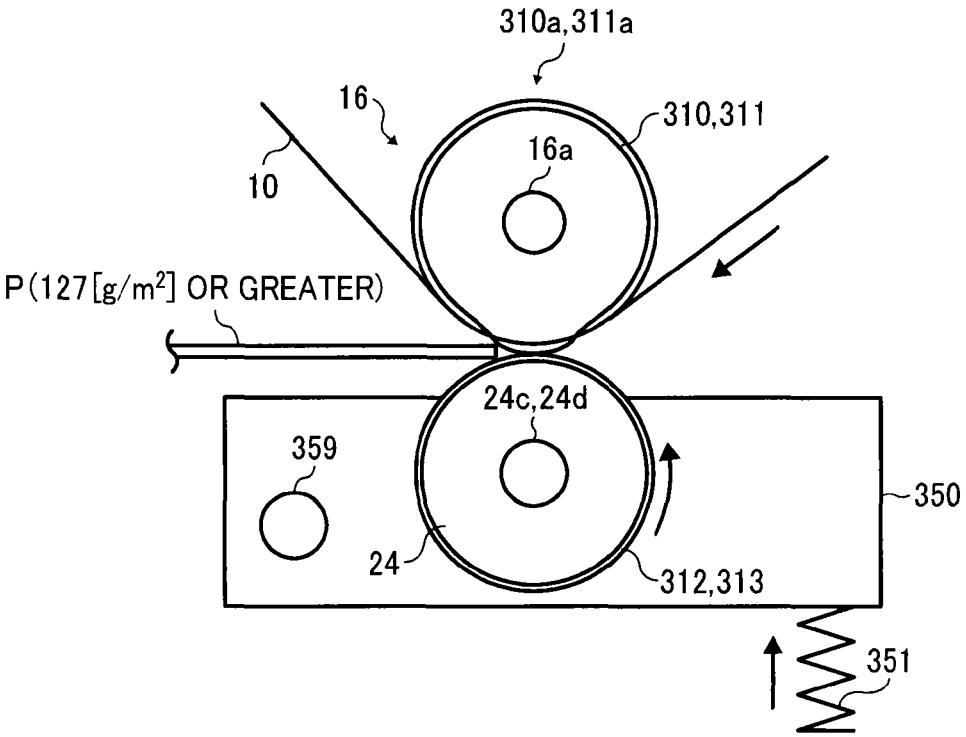
FIG. 14 is a diagram showing a state where the secondary transfer roller and the intermediate transfer belt are separated from each other by the contact-and-separation assembly, when the cardboard which is a recording sheet having a thickness of 127 g/m$^2$ or more gets out of the secondary transfer nip.

FIG. 14 shows a state where the secondary transfer roller 24 and the intermediate transfer belt 10 are separated from each other by the contact-and-separation assembly 130, when the cardboard which is a recording sheet P having a thickness of 127 g/m$^2$ or more gets out of the secondary transfer nip.

In the copier of the present embodiment, shaft members 24*c* and 24*d* of the secondary transfer roller 24 are rotatably supported by a swinging member 350 that is swingable with respect to an apparatus body about a swinging shaft 359. An urging coil spring 351 that urges the swinging member 350 upward in FIG. 14 is provided on the lower surface of this swinging member 350 such that the secondary transfer roller 24 is pressed toward the secondary transfer opposed roller 16.

Then, when the cardboard enters the secondary transfer nip, the rotation of a through shaft member 16*a* of the secondary transfer opposed roller 16 is stopped at a position where convex portions A of cams 310*a* and 311*a* of cams 310 and 311 abut on idling rollers 312 and 313, as shown in FIG. 12.

That is, when the cardboard enters the secondary transfer nip, the secondary transfer roller 24 is pressed down by the cams 310 and 311, thereby forming a clearance having a distance X between the secondary transfer roller 24 and the intermediate transfer belt 10.

Thus, the clearance having the distance X is formed between the secondary transfer roller 24 and the intermediate transfer belt 10, so that it is possible to suppress the occurrence of a large load variation to the intermediate transfer belt 10 or the secondary transfer roller 24 at the time of entering of the secondary transfer nip, even when the cardboard enters.

On the other hand, when the cardboard passes in a state where the secondary transfer roller 24 is pressed down, nip pressure that is sufficient for transferring a toner image from the intermediate transfer belt 10 to the cardboard in the secondary transfer nip is not obtained, and the transferring properties of the toner image is lowered. Particularly, in the recording sheet P that has poor surface smoothness, reduction in a transfer ratio is remarkably seen.

Therefore, immediately after the cardboard enters the secondary transfer nip, the through shaft member 16*a* of the secondary transfer opposed roller 16 is rotated such that the convex portions A of the cams 310*a* and 311*a* of the cams 310 and 311 do not abut on the idling rollers 312 and 313 respectively, as shown in FIG. 13. That is, the cams 310 and 311 are rotated clockwise or counterclockwise in FIG. 14, the cams 310 and 311 are stopped at positions where the cams 310 and 311 do not come into contact with the idling rollers 312 and 313, respectively.

Then, during the image transfer from the intermediate transfer belt 10 to the recording sheet P, the cams 310 and 311 of the secondary transfer opposed roller 16 are kept at the positions where the cams 310 and 311 do not abut on the idling rollers 312 and 313 of the secondary transfer roller 24. Consequently, it is possible to suppress reduction in nip pressure in the secondary transfer nip, and suppress reduction in the transferring properties of the toner image from the intermediate transfer belt 10 to the cardboard.

When the cardboard gets out of the secondary transfer nip, the through shaft member 16*a* of the secondary transfer opposed roller 16 is rotated and stopped such that the convex portions A of the cams 310*a* and 311*a* of the cams 310 and 311 are located at the position where the convex portions A abut on the idling rollers 312 and 313, as shown in FIG. 14.

That is, when the cardboard gets out of the secondary transfer nip, the secondary transfer roller 24 is pressed down by the cams 310 and 311, and the clearance having the distance X is formed between the secondary transfer roller 24 and the intermediate transfer belt 10.

Thus, the clearance having the distance X between the secondary transfer roller 24 and the intermediate transfer belt 10 is formed, so that it is possible to suppress the occurrence of a large load variation to the intermediate transfer belt 10 or the secondary transfer roller 24 at the time of getting out of the secondary transfer nip.

Such contact-and-separation operation between the secondary transfer roller 24 and the intermediate transfer belt 10 is performed similarly also when toner patch that adjusts toner density, or the discharge pattern of toner is drawn between sheets on the intermediate transfer belt 10 during printing operation.

At this time, the distance X of the clearance formed between the secondary transfer roller 24 and the secondary transfer opposed roller 16 may be set to such a distance that the toner patch or the discharge pattern on the intermediate transfer belt 10 does not come into contact with the secondary transfer roller 24.

The distance X is preferably 0.6 mm≤X≤1.7 mm, and is desirably about 1 mm.

Consequently, the toner of the discharge pattern or toner patch formed between sheets on the intermediate transfer belt 10 can be inhibited from coming into contact with the secondary transfer roller 24, and the toner can be inhibited from staining on the surface of the secondary transfer roller. In addition to this, it is possible to reduce cam driving torque at the time of rotating the cams 310 and 311.

Herein, a recording sheet P other than the cardboard may enter the secondary transfer nip, when the contact-and-separation operation between the secondary transfer roller 24 and the intermediate transfer belt 10 is performed at the time when the toner patch, or the discharge pattern of toner is drawn in the inter-sheet area on the intermediate transfer belt 10 during printing operation.

In this case, the cams 310 and 311 is rotated clockwise in or counterclockwise in FIG. 14, and the rotation start timing of the through shaft member 16*a* of the secondary transfer opposed roller 16 is controlled such that switching is performed for each thickness of the recording sheet P.

That is, the start timing of the separating operation between the secondary transfer roller 24 and the intermediate transfer belt 10 between sheets is changed depending on the thickness of the recording sheet P. Consequently, a clearance obtained deducting the thickness of the recording sheet P from the distance X (separation amount of the secondary transfer nip) between the secondary transfer roller 24 and the intermediate transfer belt 10 can be made substantially constant for each sheet thickness. Accordingly, it is possible to suppress the occurrence of an abnormal image resulting from returning shock that is an impact caused when the secondary transfer roller 24 and the intermediate transfer belt 10 are returned from a separation state to a contact state.

The start timing of the separating operation between the secondary transfer roller 24 and the intermediate transfer belt 10 between sheets may be controlled by changing depending on the types of the recording sheets P. Consequently, the distance X is made constant for each type of the recording sheets P, so that an abnormal image due to returning shock can be prevented from occurring.

In the copier of the present embodiment, the output control of the transfer bias can be switched between constant current output control and constant voltage output control. Then, when the secondary transfer bias at the time of transferring the toner image on the intermediate transfer belt 10 to the recording sheet P is outputted by the constant current control, and a bias applied between sheets is outputted by the constant voltage control.

When the secondary transfer roller 24 and the intermediate transfer belt 10 are brought into contact with each other, and the toner image is transferred to the recording sheet P from the intermediate transfer belt 10, a constant amount of a transfer current is required. Therefore, in the copier of the present embodiment, the secondary transfer bias is outputted by the constant current control such that a transfer field is kept constant even when the resistance of the secondary transfer roller 24, or the recording sheet P is changed.

On the other hand, when the secondary transfer roller 24 and the intermediate transfer belt 10 are separated from each other, a current is unlikely to flow, or does not flow, due to the separation between the secondary transfer roller 24 and the intermediate transfer belt 10. Therefore, when the secondary transfer bias applied between the secondary transfer roller 24 and intermediate transfer belt 10 that are separated is controlled at a constant current, a voltage is greatly increased in order that a predetermined current flows. Consequently, a current leaks to another place, thereby possibly causing the disturbance of an image or damage to the apparatus.

Therefore, in the copier of the present embodiment, a bias applied between the separated secondary transfer roller 24 and intermediate transfer belt 10 between sheets is controlled at a constant voltage. Consequently, it is possible to suppress defects resulting from abnormal rise of a voltage, as described above.

Each of the above-described embodiments described above are an example, and a transfer device and an image forming apparatus including the transfer device according to embodiments of the present invention can exert a particular effect in each of the following aspects.

Aspect A

A transfer device such as the transfer unit 60 including: a transfer member such as the secondary transfer roller 24 to contact a surface, on which a toner image is borne, of an image bearing body such as the intermediate transfer belt 10, to form a transfer nip such as the secondary nip; and a bias applicator such as the secondary transfer bias power supply 309 to apply a DC voltage and an AC voltage as a transfer bias to transfer the toner image on the image bearing body to a recording sheet such as the recording sheet P in the transfer nip, wherein the bias applicator applies a DC voltage having the same polarity as the DC voltage of the transfer bias and an AC voltage having an amplitude smaller than that of the AC voltage of the transfer bias or applies the DC voltage having the same polarity as the DC voltage of the transfer bias without applying an AC voltage, when an inter-sheet area that exists on the image bearing body passes through the transfer nip during a continuous image formation period in which a plurality of recording sheets continuously pass through the transfer nipping area and image are formed on the plurality of recording sheets. In Aspect A, an AC voltage change period, during which no AC voltage is applied or the AC voltage whose amplitudes are smaller than that of the AC voltage of the transfer bias is applied when the inter-sheet area passes through the transfer nip, exists during the continuous image formation period.

Consequently, it is possible to suppress the acceleration of the deterioration of the transfer member or the like due to the AC voltage, and suppress the shortening of the life, compared to a configuration in which such an AC voltage change period is not provided when the inter-sheet area passes through the secondary transfer nip. Additionally, the delay of the output responsiveness of the DC voltage at the time of applying the transfer bias can be made smaller than the case of applying no DC voltage, since the transferring bias applicator applies the DC voltage that has the same polarity as the polarity of the transfer bias, when the inter-sheet area passes through the transfer nip. Accordingly, the transfer bias can promptly reach a predetermined potential from the application of the transfer bias, and it is possible to suppress transfer failure caused by the shortage of the secondary transfer bias on the leading edge of the recording sheet. Therefore, member deterioration or transfer failure can be suppressed even in the case where the transfer bias including the DC voltage and the AC voltage is used.

Aspect B

The transfer device in Aspect A has a contact-and-separation unit such as the contact-and-separation assembly 130 to bring the image bearing body into contact with and separate from the transfer member, wherein the contact-and-separation unit separates the image bearing body from the transfer member, when the inter-sheet area that exists on the image bearing body passes through the transfer nip. According to this, as described in the embodiments, it is possible to suppress edge surface staining or rear surface staining of the recording sheet.

Aspect C

In Aspect B, the contact-and-separation unit separates the image bearing body from the transfer member, during a period in which a portion of the surface of the image bearing body formed with a predetermined toner pattern in the inter-sheet area passes through the transfer nip. According to this, as described in the embodiments, it is possible to suppress edge surface staining or rear surface staining of the recording sheet.

Aspect D

In Aspect C, a distance of a clearance formed between the image bearing body and the transfer member is not less than 0.6 mm and not more than 1.7 mm, when the contact-and-separation unit separates the image bearing body from the transfer member. According to this, as described in the embodiments, toner can be inhibited from staining on the surface of the transfer member.

Aspect E

The transfer device in Aspect B further includes a determination unit such as a control unit to determine whether or not the contact-and-separation unit performs contact-and-separation operation between the image bearing body and the transfer member, depending on a thickness of the recording sheet. According to this, as described in the embodiments, it is possible to suppress the occurrence of a large load variation to the image bearing body or the transfer member when the cardboard enters or gets out of the transfer nip.

Aspect F

In Aspect E, the contact-and-separation unit performs the contact-and-separation operation between the image bearing body and the transfer member, when the thickness of the recording sheet is 127 $g/m^2$ or more. According to this, as described in the embodiments, it is possible to suppress the occurrence of a large load variation to the image bearing body or the transfer member when the cardboard enters or gets out of the transfer nip.

Aspect G

In Aspect B, Aspect C, Aspect D, Aspect E or Aspect F, a start timing of separating operation between the image bearing body and the transfer member by the contact-and-separation unit is changed depending on the thickness of the recording sheet, when the inter-sheet area passes through the transfer nip. According to this, as described in the embodiments, depending on the thickness of the sheet, it is possible to suppress the occurrence of an abnormal image resulting from returning shock that is an impact caused when the transfer member and the image bearing body are returned from a separation state to a contact state.

Aspect H

In Aspect B, Aspect C, Aspect D, Aspect E or Aspect F, a start timing of separating operation between the image bearing body and the transfer member by the contact-and-separation unit is changed depending on types of the recording sheet, when the inter-sheet area passes through the transfer nip. According to this, as described in the embodiments, the occurrence of an abnormal image resulting from returning shock that is an impact caused when the transfer member and the image bearing body are returned from a separation state to a contact state can be suppressed depending on the types of the recording sheet.

Aspect I

In Aspect B, Aspect C, Aspect D, Aspect E, Aspect F, Aspect G or Aspect H, the bias applicator outputs the transfer bias applied when the toner image on the image bearing body is transferred to the recording sheet, by constant current control, and outputs a bias applied when the inter-sheet area passes through the transfer nip, by constant voltage control. According to this, as described in the embodiments, excellent transferring properties can be obtained when the toner image on the image bearing body is transferred to the recording sheet, and it is possible to suppress the occurrence of leakage when the inter-sheet area passes through the transfer nip.

Aspect J

An image forming apparatus includes a transfer device configured to transfer a toner image borne on a surface of an image bearing body, to a recording material nipped in a transfer nip by contact between the image bearing body and a transfer member, wherein the transfer device of Aspect A, Aspect B, Aspect C, Aspect D, Aspect E, Aspect F, Aspect G, Aspect H or Aspect I is used as the transfer device. According to this, as described in the embodiments, even when the transfer bias including the DC voltage and the AC voltage is used, it is possible to suppress member deterioration or transfer failure, and excellent image formation can be performed over a long period of time.

Each embodiment covers the image forming apparatus that has a configuration in which the toner image is transferred to the recording sheet P in the secondary transfer nip, but the present invention is not limited to this. For example, configurations corresponding to Aspect A to Aspect J described in each embodiment are applied to a configuration in which a toner image is transferred from a photoreceptor to a recording sheet in a transfer nip by contact between the photoreceptor and a transfer roller or the like, so that it is possible to obtain the aforementioned various effects.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A transfer device, comprising:

a transfer member to contact a surface, on which a toner image is borne, of an image bearing body, to form a transfer nip; and a bias applicator to apply a direct current (DC) voltage and an alternating current (AC) voltage as transfer bias to transfer the toner image on the image bearing body to a recording sheet in the transfer nip, wherein the bias applicator applies a DC voltage having a same polarity as the DC voltage of the transfer bias and an AC voltage having an amplitude smaller than the AC voltage of the transfer bias or applies the DC voltage having the same polarity as the DC voltage of the transfer bias without applying an AC voltage, when an inter-sheet area that exists on the image bearing body passes through the transfer nip during a continuous image formation period in which a plurality of recording sheets continuously pass through the transfer nipping area and images are formed on the plurality of recording sheets, wherein the transfer device further comprises a contact-and-separation unit to bring the image bearing body into contact with and separate from the transfer member, wherein the contact-and-separation unit separates the image bearing body from the transfer member, when the inter-sheet area that exists on the image bearing body passes through the transfer nip.

2. The transfer device according to claim 1, wherein the contact-and-separation unit separates the image bearing body from the transfer member, during a period in which a portion of the surface of the image bearing body formed with a toner pattern in the inter-sheet area passes through the transfer nip.

3. The transfer device according to claim 2, wherein a distance of a clearance formed between the image bearing body and the transfer member is not less than 0.6 mm and not more than 1.7 mm, when the contact-and-separation unit separates the image bearing body from the transfer member.

4. The transfer device according to claim 1, further comprising a determination unit to determine whether or not the contact-and-separation unit performs contact-and-separation operation between the image bearing body and the transfer member, depending on a thickness of the recording sheet.

5. The transfer device according to claim 4, wherein the contact-and-separation unit performs the contact-and-separation operation between the image bearing body and the transfer member, when the thickness of the recording sheet is 127 g/m2 or more.

6. The transfer device according to claim 1, wherein a start timing of separating operation between the image bearing body and the transfer member by the contact-and-separation unit is changed depending on the thickness of the recording sheet, when the inter-sheet area passes through the transfer nip.

7. The transfer device according to claim 1, wherein a start timing of separating operation between the image bearing body and the transfer member by the contact-and-separation unit is changed depending on type of the recording sheet, when the inter-sheet area passes through the transfer nip.

8. The transfer device according to claim 1, wherein the bias applicator outputs the transfer bias applied when the toner image on the image bearing body is transferred to the recording sheet, by constant current control, and outputs a bias applied when the inter-sheet area passes through the transfer nip, by constant voltage control.

* * * * *